US006906682B2

(12) United States Patent
Alexopoulos et al.

(10) Patent No.: US 6,906,682 B2
(45) Date of Patent: Jun. 14, 2005

(54) APPARATUS FOR GENERATING A MAGNETIC INTERFACE AND APPLICATIONS OF THE SAME

(75) Inventors: Nicolaos G. Alexopoulos, Santa Monica, CA (US); Harry Contopanagos, Santa Monica, CA (US); Chryssoula Kyriazidou, Santa Monica, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 10/226,123

(22) Filed: Aug. 23, 2002

(65) Prior Publication Data

US 2003/0043077 A1 Mar. 6, 2003

Related U.S. Application Data

(60) Provisional application No. 60/314,166, filed on Aug. 23, 2001.

(51) Int. Cl.[7] ..... H01Q 1/36
(52) U.S. Cl. ..... 343/895
(58) Field of Search ..... 343/700 MS, 846, 343/895

(56) References Cited

U.S. PATENT DOCUMENTS 3,045,237 A 7/1962 Marston ..... 343/895
3,055,003 A * 9/1962 Marston et al. ..... 343/756

(Continued)

OTHER PUBLICATIONS

U.S. Appl. No. 10/226,310, filed Aug. 23, 2002.
Alexopoulos, N.G. et al., "Scattering from an Elliptic Cylinder Loaded with an Active or Passive Continuously Variable Surface Impedence," *IEEE Antennas and Propagation*, IEEE, vol. AP–22, No. 1, Jan. 1974, p. 132–134.

(Continued)

*Primary Examiner*—Michael C. Wimer
(74) *Attorney, Agent, or Firm*—Sterne, Kessler, Goldstein & Fox P.L.L.C.

(57) ABSTRACT

A magnetic interface generator generates a magnetic interface at a center frequency $f_0$. The magnetic interface generator is a passive array of spirals that are deposited on a substrate surface. The magnetic interface is generated in a plane at a distance Z above the surface of the substrate. The distance Z where the magnetic interface is created is determined by the cell size of the spiral array, where the cell size is based on the spiral arm length and the spacing S between the spirals. The center frequency of the magnetic interface is determined by the average track length $D_{AV}$ of the spirals in the spiral array. In embodiments, the spiral array is one sub-layer in a multi-layer substrate. The spacing S of the spiral array is chosen to project the magnetic interface to another layer in the multi-layer substrate so as to improve performance of a circuit in the plane of the magnetic interface. For example, the magnetic interface can be used to increase the inductance of a printed inductor circuit, and to increase the gain and match of a microstrip patch antenna. Furthermore, the magnetic interface reduces the traverse electric (TE) and transverse magnetic (TM) surface waves in the plane of the magnetic interface, which reduces unwanted coupling between transmission lines.

26 Claims, 29 Drawing Sheets

U.S. PATENT DOCUMENTS

| | | | | | |
|---|---|---|---|---|---|
| 3,152,330 | A | * | 10/1964 | Chatelain et al. | 343/705 |
| 4,268,833 | A | * | 5/1981 | Milne | 343/833 |
| 4,804,965 | A | | 2/1989 | Roederer | 343/700 MS |
| 6,407,721 | B1 | | 6/2002 | Mehen et al. | 343/895 |

OTHER PUBLICATIONS

Broas, R.F.J. et al., "A High–Impedance Ground Plane Applied to a Cellphone Handset Geometry," *IEEE Transactions on Microwave Theory and Techniques*, IEEE, vol. 49, No. 7, Jul. 2001, pp. 1262–1265.

Caloz, C. and Itoh, T., "Multilayer and Anisotropic Planar Compact PBG Structures for Microstrip Applications," *IEEE Transactions on Microwave Theory and Techniques*, IEEE, vol. 50, No. 9, Sep. 2002, pp. 2206–2208.

Contopanagos, H. et al., "Thin Frequency–Selective Lattices Integrated in Novel Compact MIC, MMIC, and PCA Architectures," *IEEE Transactions on Microwave Theory and Techniques*, IEEE, vol. 46, No. 11, Nov. 1998, pp. 1936–1948.

Kyriazidou, C. et al., "Monolithic Waveguide Filters Using Printed Photonic–Bandgap Materials," *IEEE Transactions on Microwave Theory and Techniques*, IEEE, vol. 49, No. 2, Feb. 2001, pp. 297–307.

Merrill, W. et al., "Electromagnetic Scattering from a PBG Material Excited by an Electric Line Source," *IEEE Transactions on Microwave Theory and Techniques*, IEEE, vol. 47, No. 11, Nov. 1999, pp. 2105–2114.

Park, Y–J. et al., "A Photonic Bandgap (PBG) Structure for Guiding and Suppressing Surface Waves in MillimeterWave Antennas," *IEEE Transactions on Microwave Theory and Techniques*, IEEE, vol. 49. No. 10, Oct. 2001, pp. 1854–1859.

Sievenpiper, D. et al., "High–Impedance Electromagnetic Surfaces with a Forbidden Frequency Band," *IEEE Transactions on Microwave Theory and Techniques*, IEEE, vol. 47, No. 11, Nov. 1999, pp. 2059–2074.

Wu, H–S. and Tzuang, C–K, "PBG–enhanced Inductor," IEEE MTT–S Digest, IEEE, 2002, pp. 1087–1090.

Copy of International Search Report issued Dec. 10, 2002 for Appln. No. PCT/US02/26746, 4 pages.

* cited by examiner $$|\Gamma| = \left|\frac{E_R}{E_i}\right| = \left|\frac{R_L/R_0 - 1}{R_L/R_0 + 1}\right|$$

APPARATUS FOR GENERATING A MAGNETIC INTERFACE AND APPLICATIONS OF THE SAME

CROSS-REFERENCE TO RELATED APPLICATIONS

This application claims the benefit of U.S. Provisional Application No. 60/314,166 filed on Aug. 23, 2001, which is incorporated herein by reference in its entirety.

BACKGROUND OF THE INVENTION

1. Field of the Invention

The present invention generally relates to a magnetic interface, and applications of the same.

2. Related Art

Radio frequency and microwave integrated circuits (collectively called RFICs herein), include active components and passive components that are printed or deposited on a suitable substrate. The various active and passive components are connected together with transmission lines. Exemplary transmission lines include microstrip transmission line, stripline, and/or co-planar waveguide transmission line.

Active components typically include one or more transistors that require DC bias for proper operation. Examples of active circuits include amplifiers, oscillators, etc. Passive components do not require DC bias for proper operation. Examples of passive components include inductors and capacitors, which can be configured as filters, multiplexers, power dividers, phase shifters, etc., and other passive circuits. Passive components are also incorporated in the bias circuitry of active components.

Inductors are an important building block for many passive components. They can be generally classified into two categories, namely discrete inductors and printed inductors. Discrete inductors (e.g., leaded inductors, surface mounted inductors, and air coil inductors) are generally packaged in containers having terminals that are electrically connected to a substrate using solder or epoxy. In contrast, printed inductors are not packaged in a container. Instead, printed inductors have patterns of conductive material that are printed or deposited directly on the substrate. The patterns of conductive material are often called spiral arms, or traces.

The integration of discrete inductors onto a substrate requires expensive assembly techniques. Therefore, RFICs that have discrete inductors are more costly to manufacture than those using printed inductors. Accordingly, it is desirable to use printed inductors in RFICs whenever possible to minimize cost and assembly time.

Unfortunately, replacing discrete inductors with less expensive printed inductors typically requires a tradeoff in circuit footprint. Conventional printed inductors are typically larger than their discrete inductor counterparts for a given inductance value. Furthermore, printed inductors are typically unshielded, and therefore receive and radiate unintentional electromagnetic radiation through the substrate. As a consequence, conventional printed inductors need to be spaced at a some distance from other electronic components on the substrate in order to minimize electromagnetic interaction with other electronic components (including other inductors).

Therefore, what is needed is a printed inductor configuration that produces a high inductance value, but that minimizes substrate area, and unintentional radiation with other components.

SUMMARY OF THE INVENTION

The present invention is a magnetic interface generator that generates a magnetic interface at a center frequency $f_0$. The magnetic interface generator is a passive array of spirals that are deposited on a substrate surface. The magnetic interface is generated in a plane at a distance Z above the surface of the substrate. The distance Z where the magnetic interface is created is determined by the cell size of the spiral array, where the cell size is based on the spiral arm length and the spacing S between the spirals. The center frequency $f_0$ of the magnetic interface is determined based on the average track length $D_{AV}$ of the spirals in the spiral array.

In embodiments, the spiral array is one layer in a multi-layer substrate. The spacing S of the spiral array is chosen to project the magnetic interface to another layer in the multi-layer substrate so as to improve performance of a circuit in the plane of the magnetic interface. For example, the magnetic interface can be used to increase the inductance of a printed inductor circuit. In another example, the magnetic interface is used to increase the gain and match of a microstrip patch antenna. Alternatively, for a given inductance or antenna gain value, the circuit footprint of the respective component can be reduced by using the spiral array to generate the magnetic interface, thereby increasing circuit density and reducing the per unit manufacturing cost.

Furthermore, the magnetic interface reduces transverse electric (TE) and transverse magnetic (TM) surface waves that lead to unwanted coupling between adjacent transmission lines (e.g. microstrip lines) on a substrate. TE and TM surface waves are reduced because the magnetic interface appears as an equivalent lowpass structure to the surface waves. The result is that unwanted coupling is reduced between adjacent transmission lines by the magnetic interface, allowing for an increase in circuit densities.

Further features and advantages of the present invention, as well as the structure and operation of various embodiments of the present invention, are described in detail below with reference to the accompanying drawings.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE EMBODIMENTS

1. Properties of Electric and Magnetic Conductors

Figure 1A:
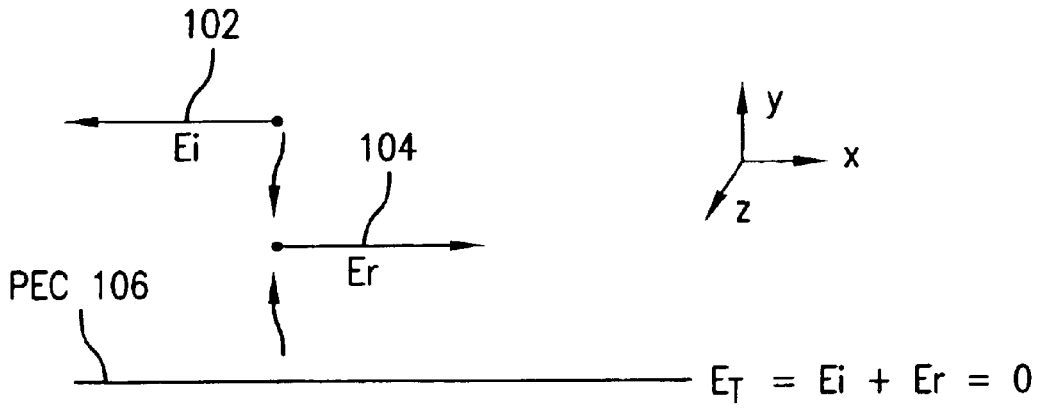
FIG. 1A illustrates an electric field incident on a perfect electrical conductor.
Figure 1B:
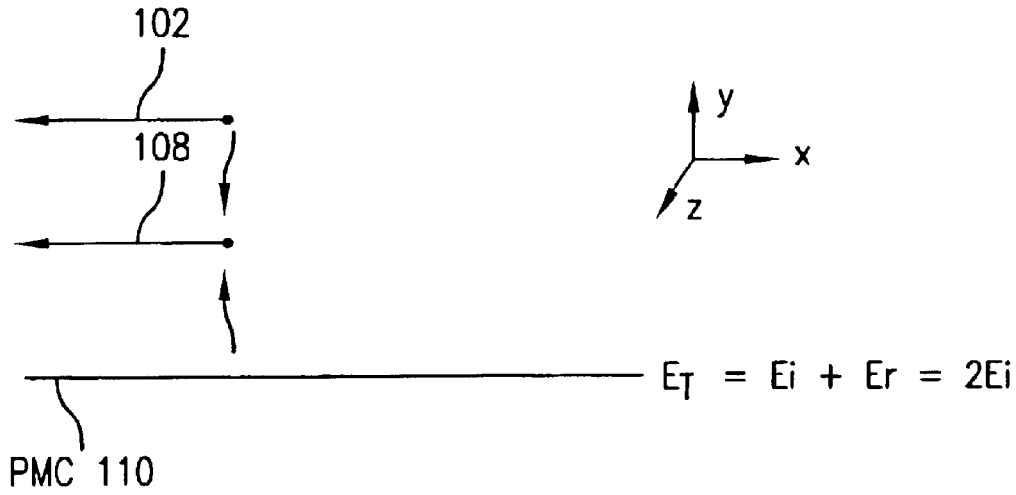
FIG. 1B illustrates an electric field incident on a perfect magnetic conductor.

Before describing the invention in detail, it is useful to describe some properties of electric and magnetic conductors. FIG. 1A illustrates a perfect electric conductor (PEC) 106, and FIG. 1B illustrates a perfect magnetic conductor (PMC) 110. When an incident electric field ($E_1$) 102 hits the PEC 106, a reflected electric field ($E_r$) 104 is generated that is equal in amplitude and opposite in phase. Therefore, at the surface of PEC 106, the total electric field ($E_T$) is 0, which is consistent with a short circuit. When the incident electric field ($E_1$) 102 hits the PMC 110, a reflected electric field ($E_r$) 108 field is generated that is equal in amplitude and also equal in-phase with the $E_1$ 102. Therefore, at the surface of the PMC 110, the total electric field is double that of the $E_1$ 102.

Figure 1C:
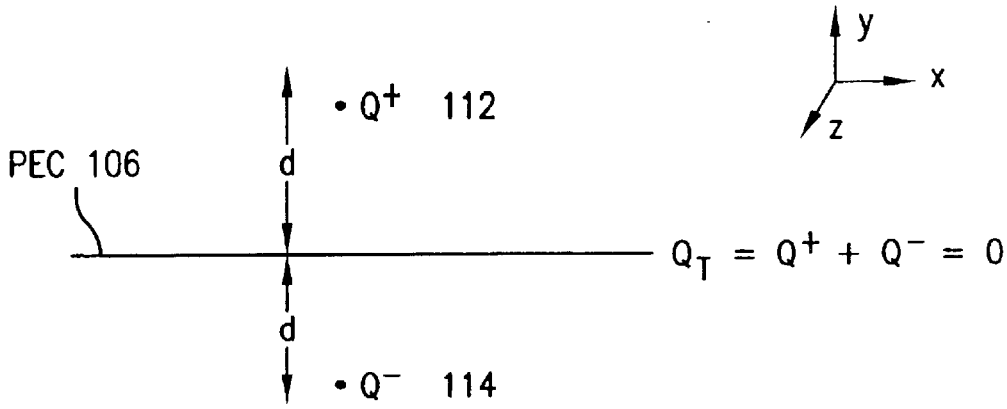
FIG. 1C illustrates a charge Q above a perfect electrical conductor.
Figure 1D:
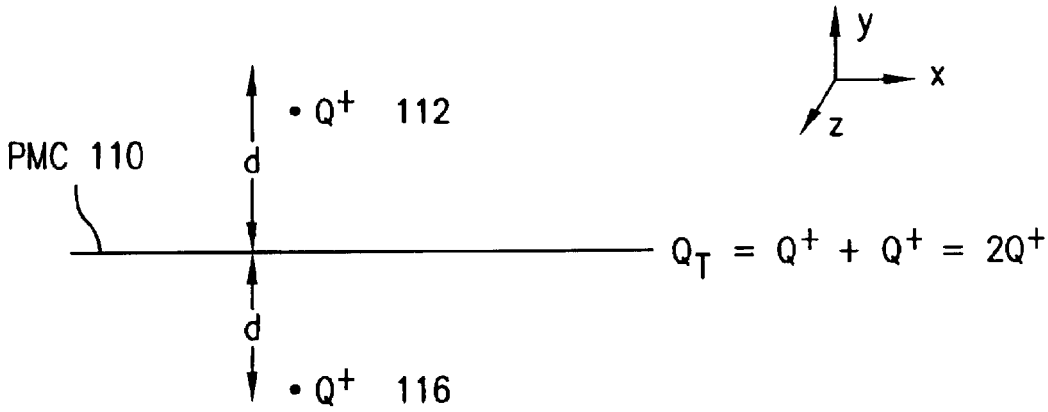
FIG. 1D illustrates a charge Q above a perfect magnetic conductor.

Referring to FIG. 1C, when a charge $Q^+$ 112 is placed at a distance d above the PEC 106, then a charge $Q^-$ 114 is generated on the otherside of the PEC 106 that is the negative of $Q^+$ 112. As d approaches 0, then the $Q^+$ 112 and $Q^-$ 114 cancel each other on the surface of the PEC 106, which is consistent with a short circuit. However, when the charge $Q^+$ 112 is placed above the PMC 110 (FIG. 1D), then a charge $Q^+$ 116 is generated that is equal to $Q^+$ 112 and has the same sign. Therefore, as d approaches 0, then the $Q^+$ 112 and $Q^+$ 116 add together on the surface of the PEC 106, to double the charge on the surface of the PMC 110.

Figure 1E:
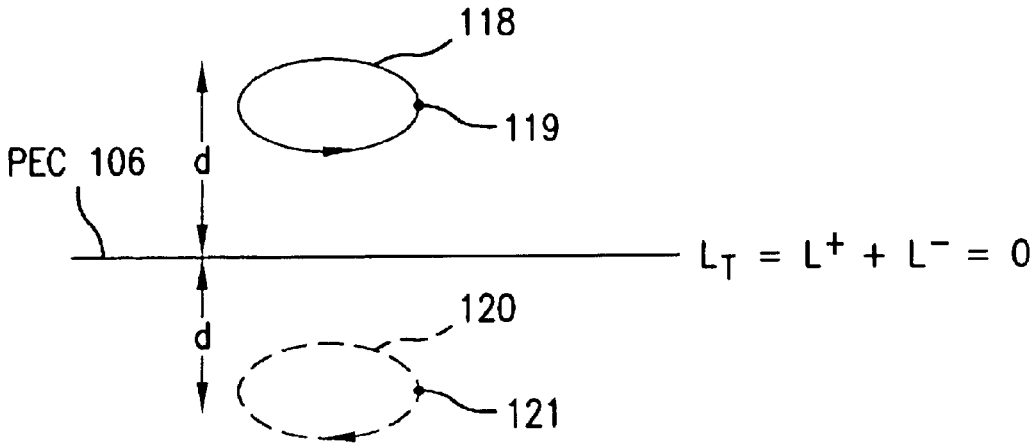
FIG. 1E illustrates a current above a perfect electrical conductor.
Figure 1F:
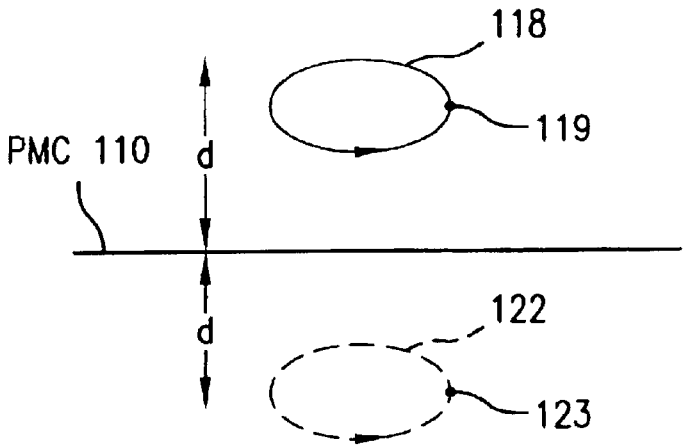
FIG. 1F illustrates a current above a perfect magnetic conductor.

Referring to FIG. 1E, an inductor 118 having an inductance $L^+$ is placed above the PEC 106 at a distance d, where the inductor 118 is a wire loop carrying a charge 119. Based on the discussion above, the PEC 106 induces an image charge 121 traveling in the opposite direction that defines an image inductor 120 having an inductance $L^-$. As d approaches 0, the charge 119 and the charge 121 cancel on the surface of the PEC 106, and therefore the total inductance on the PEC 106 is 0. In other words, if the inductor 118 is placed directly on a PEC 106 (or ground), then the inductor is shorted-out and the total inductance $L_T$ is 0.

However, if inductor 118 is placed above the PMC 110 at a distance d, then the PMC 110 induces an image charge 123 traveling in the same direction at a distance d to define an image inductor 122 having the inductance $L^+$. As d approaches 0, the charge 119 and the charge 123 add together on the surface of the PMC 110, and therefore the total inductance on the PMC 106 is $2L^+$. In other words, if the inductor 118 is placed directly on the PMC 110, then the effective inductance is doubled.

It should be apparent that a perfect magnetic conductor produces significant advantages when used with inductor circuits. Specifically, given a defined substrate area, it is theoretically possible to dramatically increase the inductance value for a printed inductor that is printed over a perfect magnetic surface. Or stated another way, given a desired inductance value, the required substrate area when using a PMC surface is ½ of the required substrate area without the PMC surface. Accordingly, the surface area of an integrated circuit can be more efficiently utilized when using a PMC surface under printed inductors, or an equivalent to a PMC surface.

2. Surface Reflection Coefficient

Figure 2A:
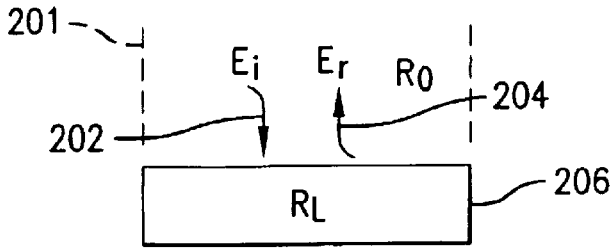
FIG. 2A illustrates the reflection coefficient associated with an electric field that is incident on a load surface $R_L$.

FIG. 2A illustrates the reflection of an electromagnetic field (EM) 202 traveling a first medium 201 from a surface 206 to generate a reflected EM signal 204. A reflection coefficient Γ represents the ratio of the amplitude of $E_r$ 204 relative to the amplitude of $E_1$ 202. Assuming a characteristic impedance $R_0$ for the first medium 201 and a characteristic impedance $R_L$ for the surface 206, the reflection coefficient Γ can be calculated as follows:

$$|\Gamma|=|E_r/E_1|=|(R_L/R_0-1)/(R_L/R_0+1)| \quad \text{Eq. 1}$$

Figure 2B:
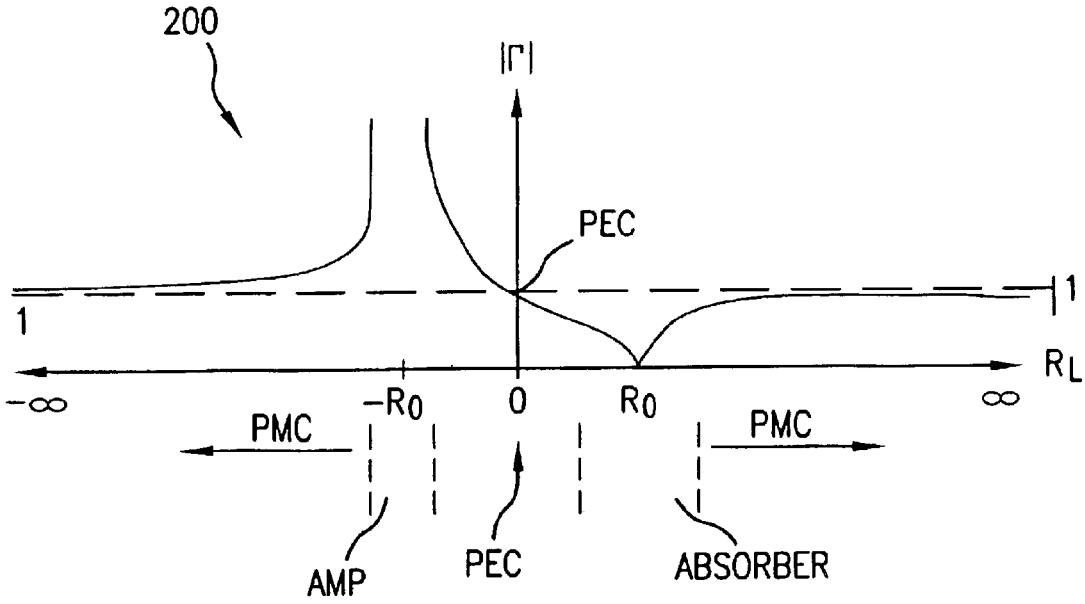
FIG. 2B illustrates a plot of reflection coefficient versus $R_L$.

FIG. 2B illustrate a plot 200 of |Γ| for various load resistance $R_L$. When $R_L$=approaches −∞ or +∞, then |Γ| asymptotically approaches 1, and the surface 206 is equivalent to a PMC surface. When $R_L=-R_0$, then $|\Gamma|$ approaches infinity and the surface 206 operates as an amplifier. (Negative resistance occurs when an active device is in oscillation mode.) When $R_L=0$ (i.e. short circuit), then $|\Gamma|=1$, which indicates a perfect reflection so that the surface 206 is operating as a perfect electric conductor. When $R_L=R_0$, then $|\Gamma|=0$, which indicates that there is no reflected energy and the surface 206 is operating as a perfect absorber. Therefore, based on FIGS. 2A–2B, various equivalent reflection coefficients can be produced by changing the load impedance $R_L$ of the surface 206.

Still referring to FIG. 2B, it is noted a reflection coefficient $|\Gamma|=1$ is characteristic of both a PMC interface and a PEC interface. However, the phase of the reflection coefficient $\Gamma$ is in-phase (or zero degrees) for the PMC interface, and is 180 degrees out-of-phase for the PEC interface.

Figure 3A:
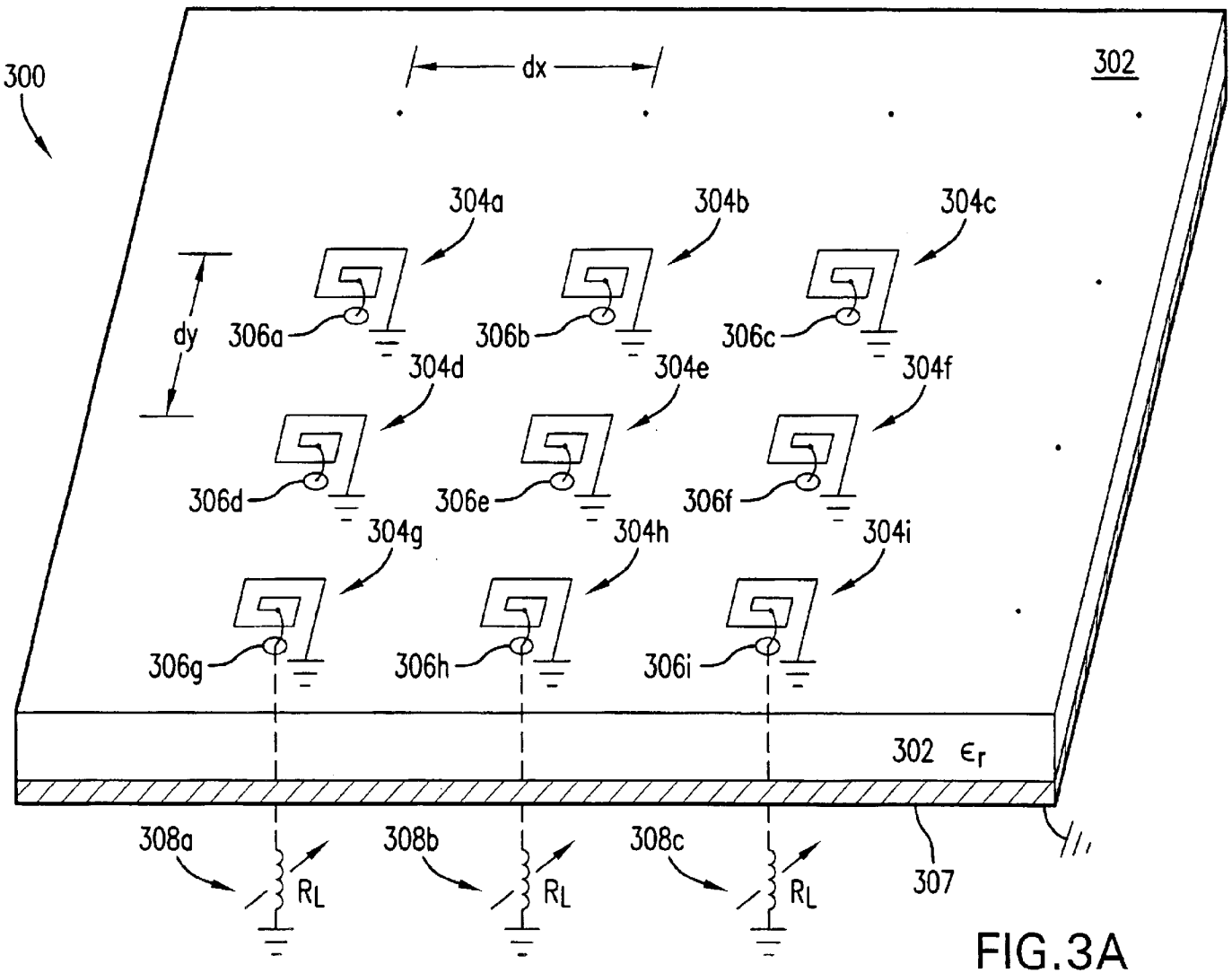
FIG. 3A illustrates a variable Γ interface that produces variable reflection coefficients.

FIG. 3A illustrates a variable $\Gamma$ interface 300 that can be configured to have any of the reflection properties that are illustrated by graph 200 in FIG. 2. Variable interface 300 includes a substrate 302 that is mounted on a sheet conductor 307, which is grounded. The substrate 302 can be any type of substrate and is usually chosen based on the specific application. Example substrates include duriod, polymide, silicon, or even air. Note that for an air substrate, the spirals 304 are suspended above the substrate 302. The sheet conductor 307 preferably is a good conductor having a low resistivity.

Figure 3B:
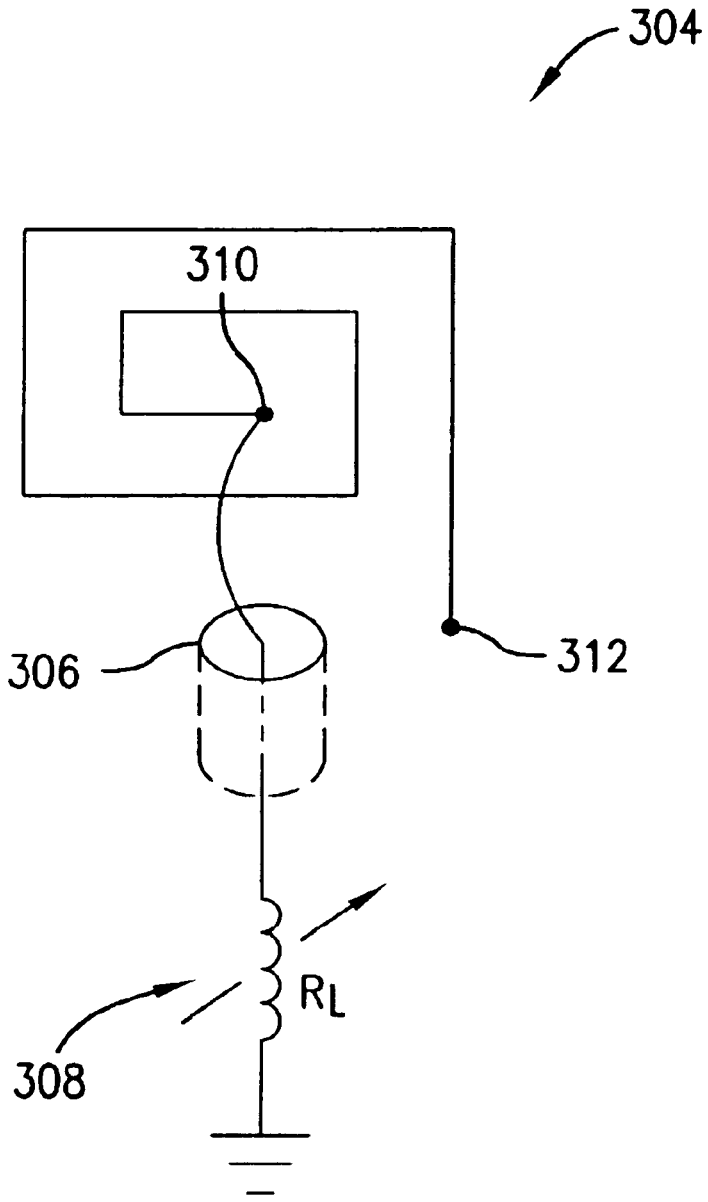
FIG. 3B illustrates an exemplary spiral on the variable Γ interface.

The substrate 302 has an array of spirals 304*a–n* that are deposited on the top surface of the substrate 302. The array of spirals 304 are spaced a distance of dx from each other in the x-direction, and a distance of dy from each other in the y-direction, as shown. Referring to FIG. 3B, each spiral 304 has a two terminals 310 and 312. The terminal 312 is grounded to the sheet conductor 307. Therefore, each terminal 312 is at the same ground potential since all the terminals 312 are shorted together by the sheet conductor 307. The second terminal 310 is connected to a variable load 308 through a via hole 306 that passes through the substrate 302 and the sheet conductor 307.

Figure 3C:
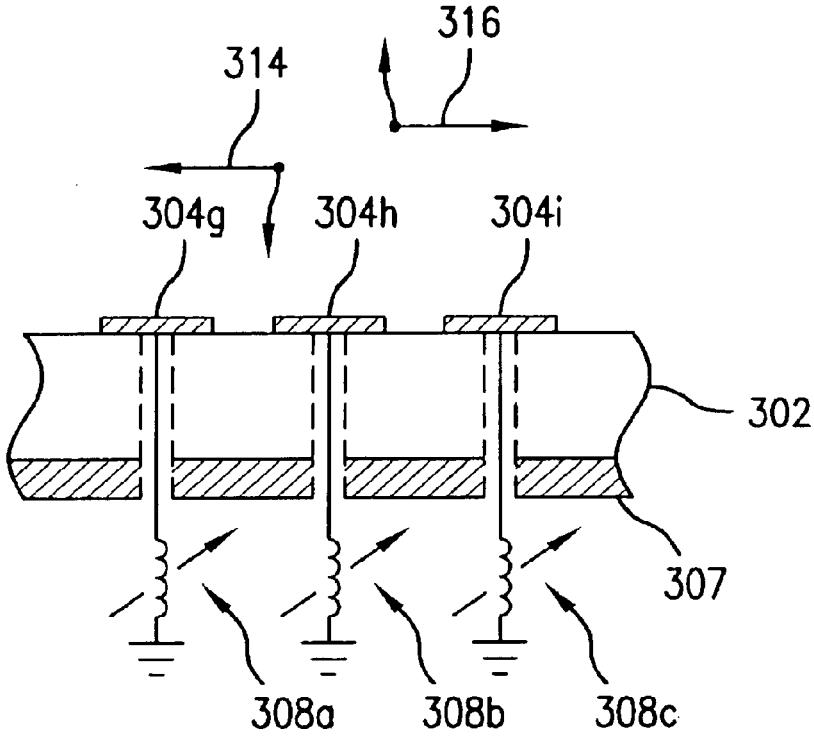
FIG. 3C illustrates a cross-section of the variable Γ interface.

FIG. 3C illustrates a side view of the interface 300 having an incident EM signal 314, that produces a reflected EM signal 316. The variable surface 300 can be configured to produce any $|\Gamma|$ coefficient on the $|\Gamma|$ curve 200 (FIG. 2B) by adjusting the variable loads 308. For example, the variable surface 300 can be configured as an absorber ($|\Gamma|=0$) by setting the variable loads 308$=R_0$, where $R_0$ is the characteristic impedance for the incident EM signal 314. The variable surface 300 can also be configured as an amplifier ($|\Gamma|=\infty$) by setting the variable resistors 308$=-R_0$. The surface 300 can be configured as an electric conductor ($|\Gamma|=1$) by setting the variable resistors 308=0, thereby shorting the spirals terminals 310 to ground. Finally, the interface 300 can be configured as a magnetic interface by setting the variable resistors 308 to be $\pm\infty$. Since infinite resistance cannot be achieved, the magnetic interface can be approximated by setting the variable resistors 308 to be sufficiently large in value so that $|R_L/R_0|>>1$.

As stated above, the magnetic interface can be approximated by setting the variable resistors 308 to be sufficiently large in value so that $|R_L/R_0|>>1$. In an active embodiment, this is accomplished by setting $R_L$ to be a large negative resistance, which is left side of FIG. 2B. Negative resistance can be produced using active devices that are configured to oscillate. For example, transistors in oscillation provide a negative resistance at the oscillation port. In a passive embodiment, the magnetic interface can be approximated by setting $R_L$ to a large positive resistance, which can be accomplished with standard passive resistors.

3. Passive Magnetic Interface Realization

Figure 4A:
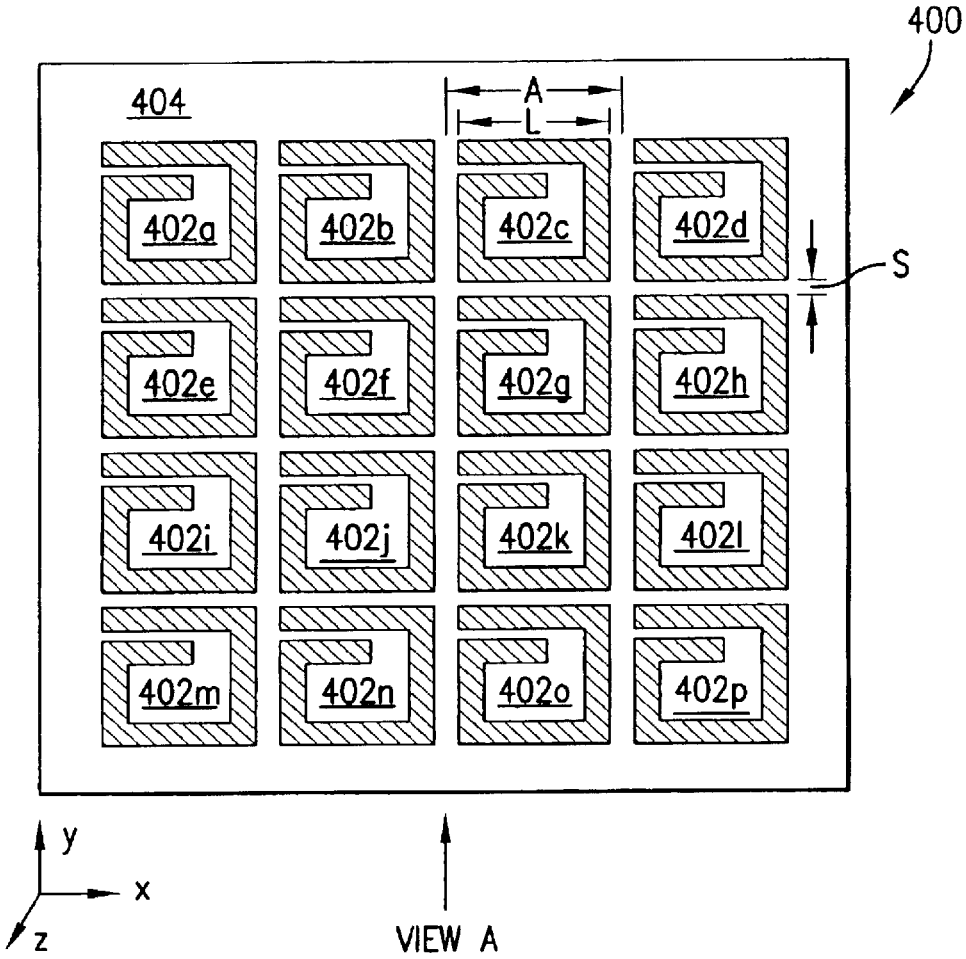
FIGS. 4A–4D illustrate a magnetic interface generator that includes an array of spirals according to one embodiment of the invention.
Figure 4B:
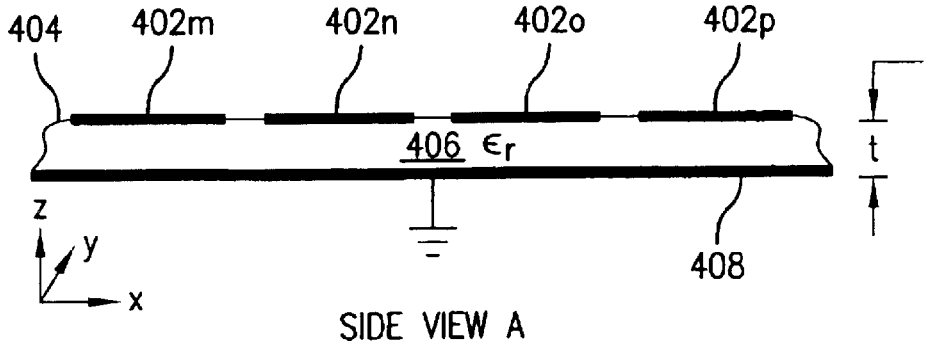

FIGS. 4A–4B illustrate a magnetic interface generator 400 according to one embodiment of the invention. The magnetic interface generator 400 is a completely planar design that does not require external variable resistors or fixed resistors to create the magnetic interface. FIG. 4A illustrates the top view of the magnetic interface generator 400, and FIG. 4B illustrates a side view of the magnetic interface generator.

Referring to FIGS. 4A–4B, the magnetic interface generator 400 includes: a substrate 406 having a top surface 404 and a bottom surface 408; and an array of multi-turn spirals 402*a–p* that are deposited or printed on the top surface 404. The substrate 406 has a thickness T and the bottom surface 408 is metallized and is connected to ground. The substrate 406 also has a relative dielectric constant $\in_r$. Example dielectrics that could be used for the substrate 406 include duriod, polyamide, silicon, or even air. In a multi-layered architecture, the one level multi-turn spirals may be extended to multi-level spirals, with vias connecting the various levels of the spiral.

The spirals 402 are passive metallic traces that are printed periodically on the surface 404 of the substrate 406, and are spaced a distance S from each other. The terminals of the spirals 402 are open circuited, without vias connecting the terminals to the ground conductor 408. In contrast, in FIG. 3A, the spirals 304 utilize vias through the substrate 302 that connect the terminals to the ground 307 and the variable loads 308*a–c*. Therefore, the fabrication of the magnetic interface generator 400 is simpler and less expensive than the active configuration that is shown in FIG. 3A.

The magnetic interface generator 400 can be further described by a cell size A as shown in FIG. 4A. The cell size A includes the length L of the spiral 402, and the spacing S. More specifically, the cell size A includes the length L of a spiral arm, and ½ of the spacing S on each side of L.

Figure 4C:
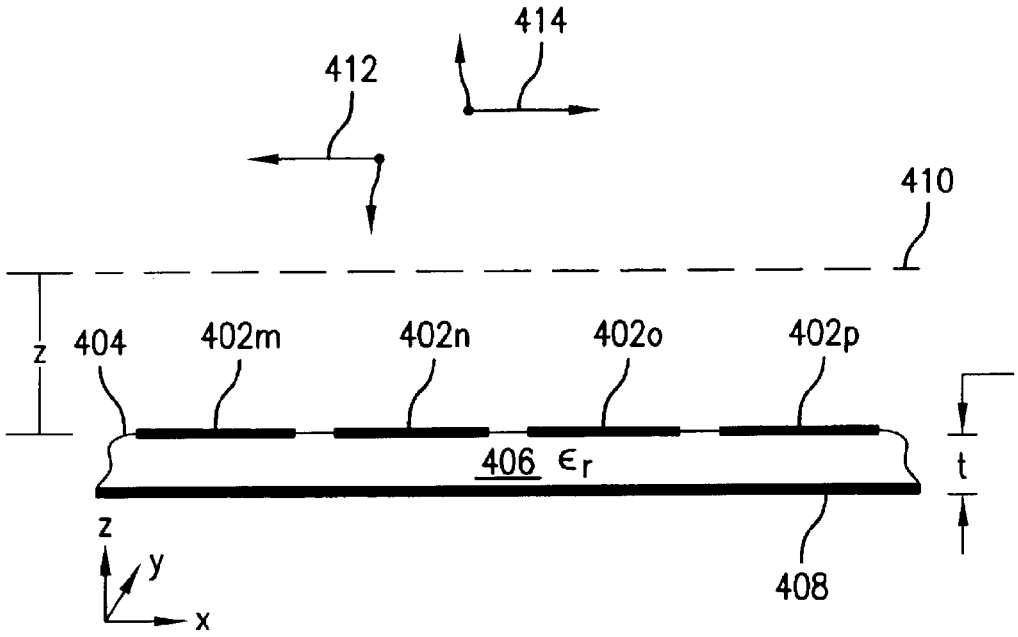

Referring to FIG. 4C, the magnetic interface generator 400 generates a magnetic interface 410 that lies in the xz plane at a distance Z above the top surface 404 of the substrate 406. The distance Z is determined by the spacing S of the spirals 402 and the cell size A. In other words, the magnetic interface 410 can be moved up and down in the z-direction by adjusting spacings S between the spirals 402.

The magnetic surface 410 behaves like a magnetic mirror over a particular frequency bandwidth. Incident radiation within a particular frequency band is reflected in-phase at the magnetic interface 410. For example, the magnetic interface 410 reflects an incident electric field ($E_1$) 412 to generate a reflected electric field ($E_r$) 414 field that is substantially in-phase with the $E_1$ field 412. Therefore, the reflection coefficient $\Gamma$ is as follows:

$$\Gamma=E_r/E_1=|E_r/E_1|e^{j\theta}, \text{ where } \theta=0. \qquad \text{Eq. 2}$$

In other words, the phase of the reflection coefficient is substantially 0 at the magnetic interface 410 at the center frequency $f_0$ of operation. Since the incident field ($E_1$) 412 and the reflected field ($E_r$) 414 are substantially in phase, the field at the magnetic interface 410 effectively doubles.

Figure 4D:
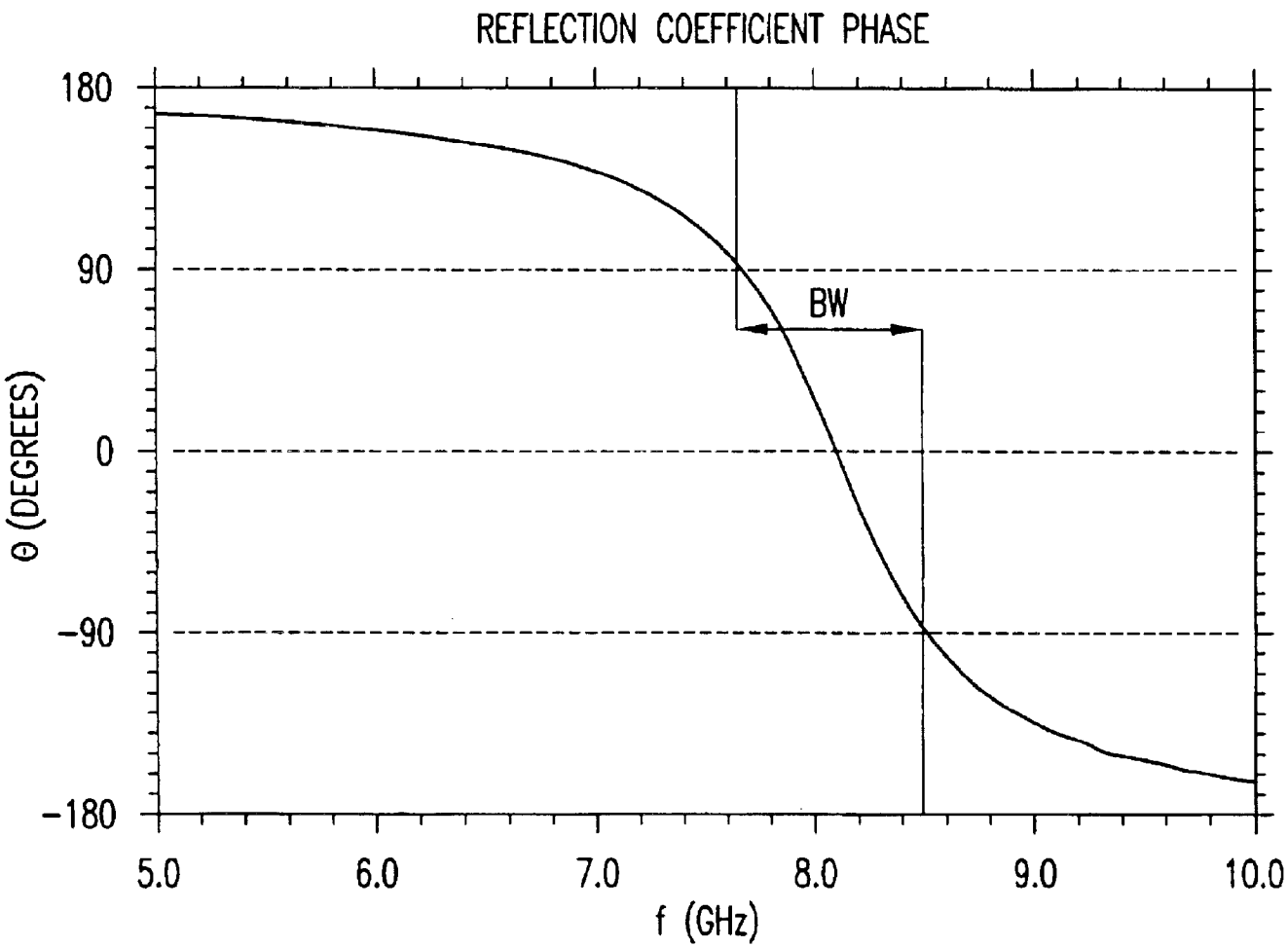

FIG. 4D illustrates an example plot of reflection coefficient phase for a magnetic interface 410 that is designed to be resonant at a center frequency $f_0$=8 Ghz. As shown, the reflection coefficient phase is approximately 0 degrees at 8 Ghz. The useable frequency bandwidth is the frequency range that corresponds to a reflection coefficient phase between −90 degrees and +90 degrees. In FIG. 4D, the useable frequency bandwidth is approximately between 7.6 Ghz –8.5 Ghz. As discussed further below, the center frequency $f_0$ of operation is determined by the average track length of the spiral 402.

The magnetic interface generator 400 is a completely passive design that does not require active loads or negative resistance to generate the magnetic interface 410. As such, the magnetic interface generator 400 operates on the extreme right side of the Γ plot 200 that is shown in FIG. 2B.

Figure 5:
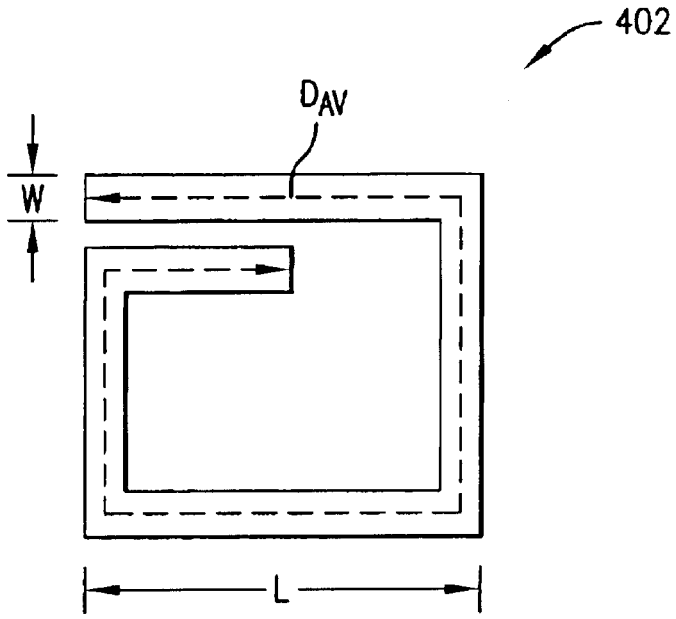
FIG. 5 and FIG. 6 illustrate exemplary spirals according to embodiments of the present invention.

FIG. 5 further illustrates an example spiral 402. The spiral 402 is defined by a metal track width W, a length L, and the average track length $D_{av}$. The average track length $D_{av}$ is the track length around the spiral 402, and is measured from the middle of the track W, as shown. The average track length $D_{av}$ determines the center frequency $f_0$ of operation of the magnetic interface 410 according to the following equation:

$$f_0 = \frac{c}{2D_{av}\sqrt{\frac{1+\varepsilon_r}{2}}} \quad \text{Eq. 3}$$

$$c = 3\times10^8 \text{ m/sec}$$

$$\varepsilon_r = \text{relative permittivity}$$

Stated another way, $D_{av}$ determines the frequency at which the phase of the reflection coefficient is 0 degrees. Since $D_{av}$ is in the denominator of Eq. 3, the center frequency of the magnetic interface 410 generally decreases with increasing track length $D_{av}$. Given a desired center frequency of operation $f_0$, Eq. 3 can be solved for $D_{AV}$ as follows:

$$D_{av} = \frac{c}{2f_0\sqrt{\frac{1+\varepsilon_r}{2}}} \quad \text{Eq. 4}$$

Figure 6:
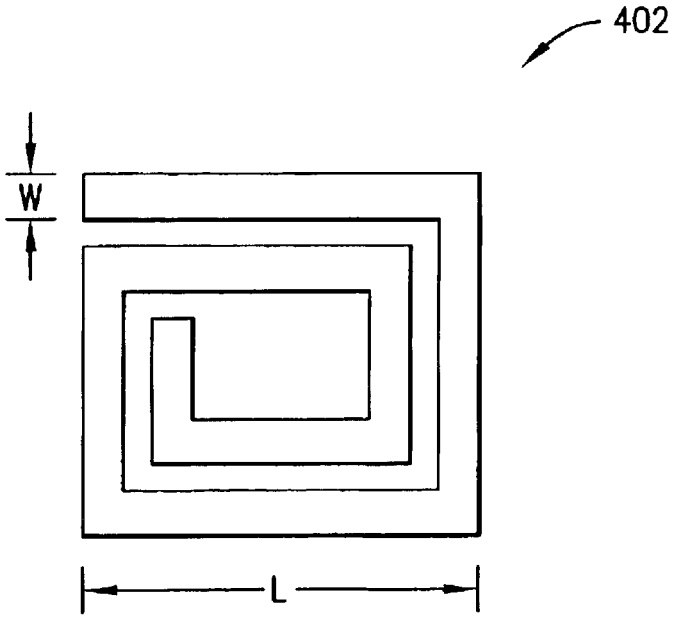

The spiral 402 can also be described according to the "number of turns" in the spiral. For example, in FIG. 5, the spiral 402 has 1.25 turns. In FIG. 6, the spiral 402 has approximately 2 turns. Everything else being equal, $D_{av}$ generally increases with increasing number of spiral turns. Therefore, for a given $D_{AV}$, the overall size of the spiral 402 can generally be decreased by increasing the number of turns in the spiral 402. Stated another way, the cell size A of the spirals 402 can be decreased by winding the spirals tighter or using multi-level spirals.

4. Applications for a Magnetic Interface

The following section describes some example applications for the passive magnetic interface generator that was described above. These applications are for example purposes only, and are not meant to be limiting. Those skilled in the arts will recognize other applications based on teachings given herein. These other applications are within the scope and spirit of the present invention.

4a. Inductor Circuit

As described in Section 1 herein, significant advantages can be realized when utilizing an inductor with a magnetic interface, such as the magnetic interface 410 generated by the magnetic interface generator 400. Specifically, conventional inductors present an inductive impedance that increases with frequency until the self-resonance frequency of the inductor is reached. Beyond the self-reasonance frequency, the inductor becomes a capacitor. However, the magnetic interface 410 creates two inductive modes on the inductor, one that would naturally exist (up to its self-resonant frequency) and a second inductive mode that is induced by the magnetic interface at the frequency band where the magnetic interface operates. This multi-mode capability saves IC surface area that would be occupied by as many separate inductors.

Figure 7A:
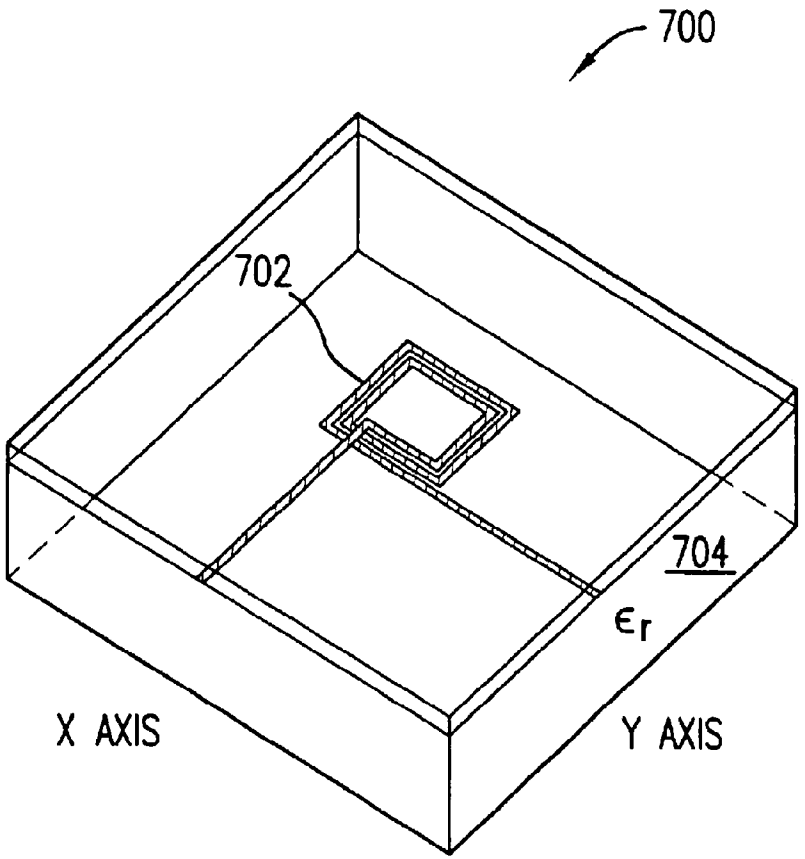
FIG. 7A illustrates a conventional printed circuit inductor.
Figure 7B:
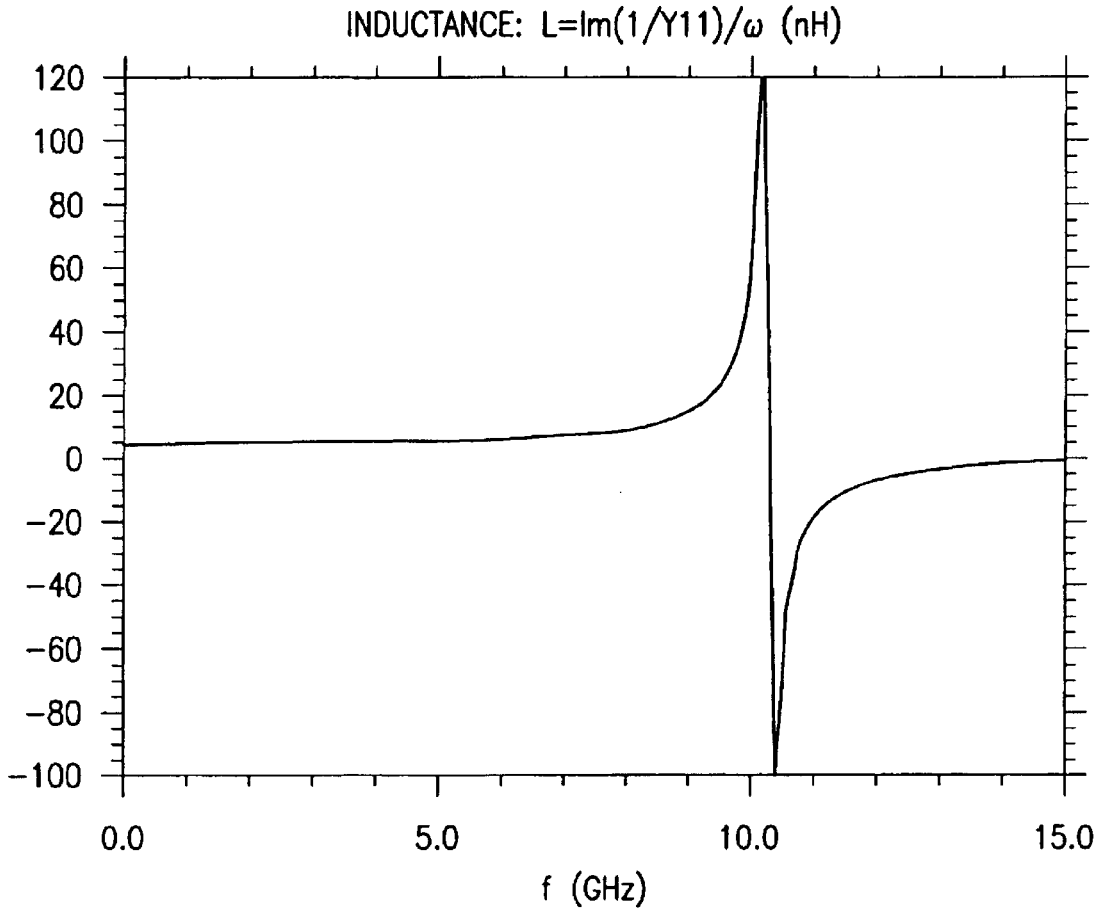
FIG. 7B illustrates admittance values over frequency for the conventional printed inductor in FIG. 7A.

FIG. 7A illustrates a conventional inductor circuit 700 having a printed inductor 702 that is printed on a top surface of a substrate 704. FIG. 7B illustrates a plot of inductive impedance normalized to frequency for the inductor 702 according the following equation: $L(\omega)=\mathrm{Im}(1/Y_{11})/\omega$.

Figure 8A:
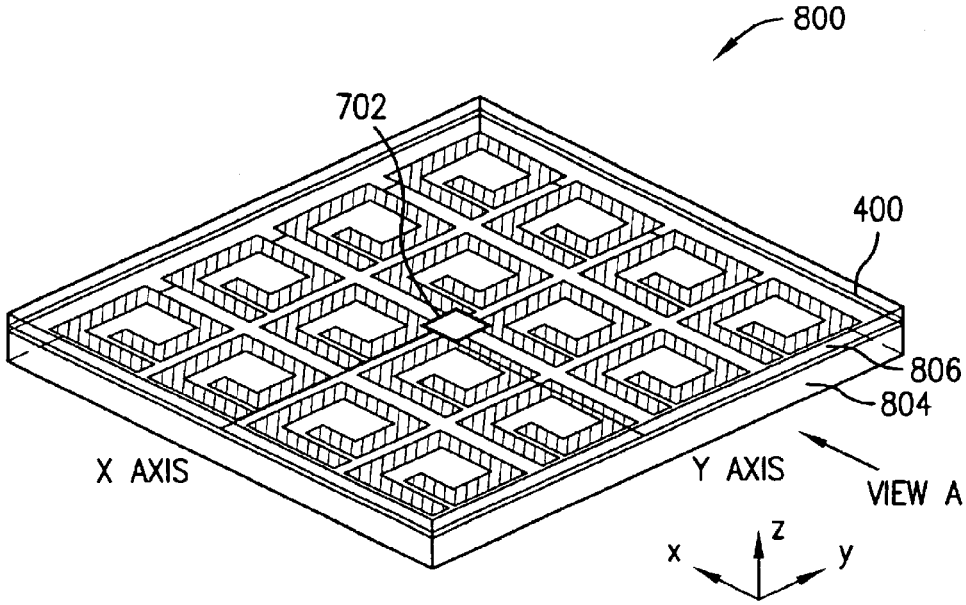
FIGS. 8A and 8B illustrate an inductor circuit 800 that utilizes a magnetic interface to increase the effective inductance according to embodiments of the present invention.
Figure 8B:
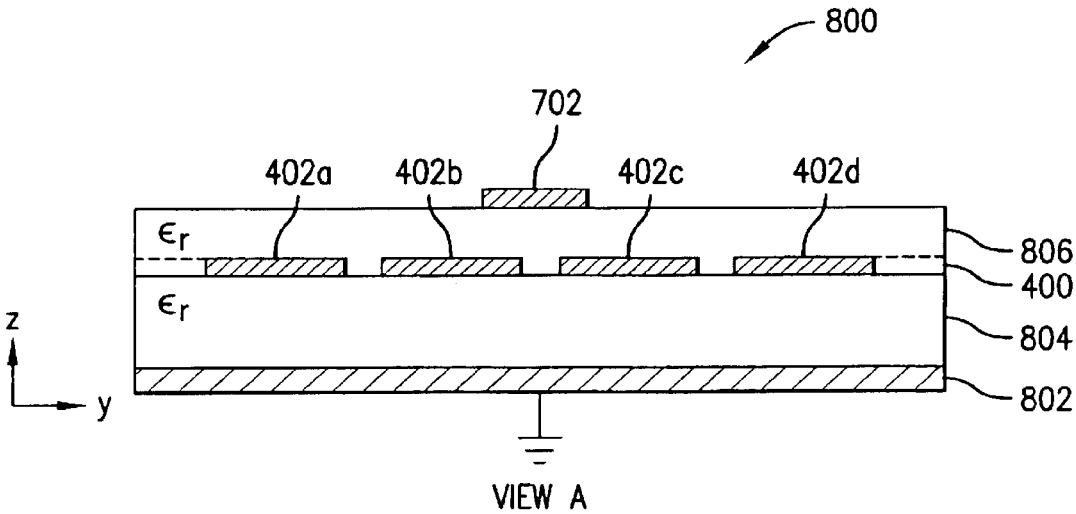

FIGS. 8A and 8B illustrate an inductor circuit 800 that utilizes a magnetic interface to create a dual inductive mode for the inductor 702. From the ground up, the inductor circuit 800 includes a ground layer 802, a first substrate layer 804, the magnetic interface generator (or "spiral layer") 400 having the array of spirals 402, a second substrate layer 806, and the printed inductor 702. The spiral layer 400 is printed on the first substrate layer 804, and is therefore sandwiched between the first substrate layer 804 and the second substrate layer 806. The printed inductor 702 is then printed on the top surface of the second layer 806. The spacing S between the spirals 402 is configured so that the magnetic interface appears on the top of the surface 806. In other words, the spacing S between the spirals 402 is set so that the magnetic interface is in the same plane as the printed inductor 702. In embodiments, the number of spirals 402 needed to effect the magnetic interface as described herein can be 3 to 4 spirals around the inductor 702.

Figure 9A:
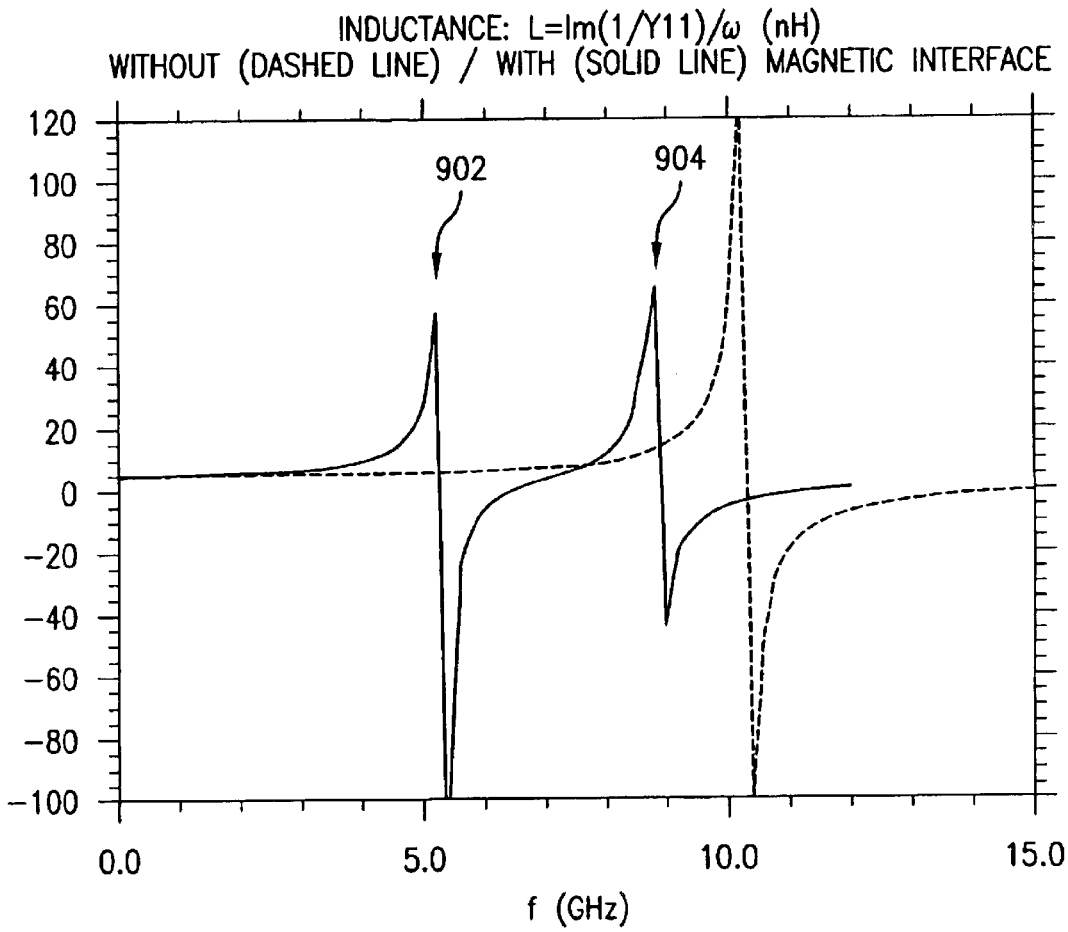
FIG. 9A illustrates example plots of the normalized inductive impedance L (ω) for the inductor circuits 700 and 800.
Figure 9B:
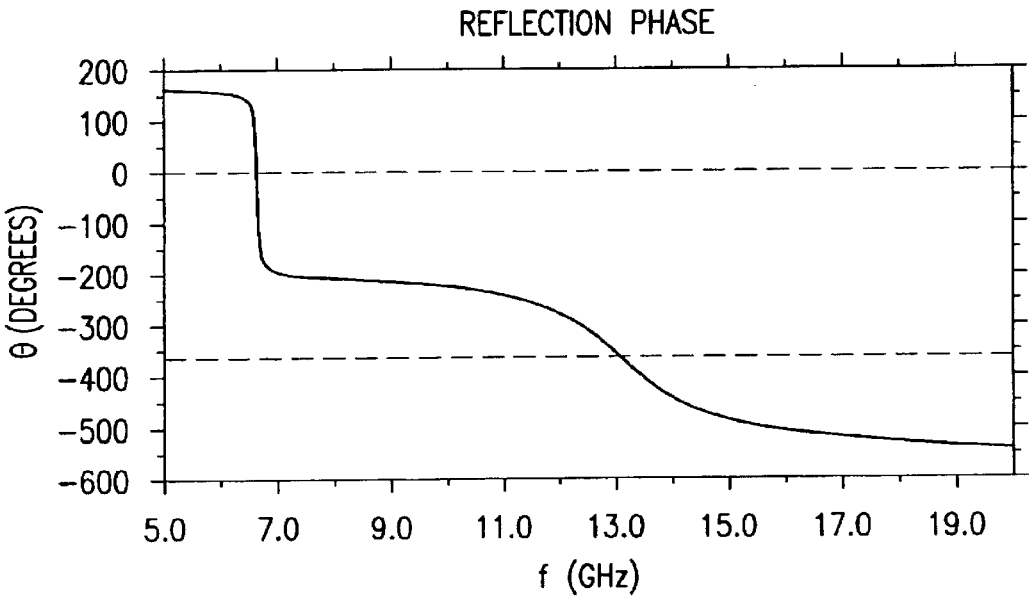
FIG. 9B illustrates the phase of the reflection coefficient for the spiral array 400 in the inductor circuit 800 according to embodiments of the present invention.

FIG. 9A illustrates an example plot of the normalized inductive impedance $L(\omega)$ for the inductor circuit 800, when the spiral layer 400 is configured to be resonant at 7 GHz, and the substrate dielectric is polyamide. We observe the dual-mode inductive impedance (902 and 904), where the second mode 904 is due to the existence of the magnetic interface. This system can be used for example, as a dual RF choke, at the resonances shown instead of using two separate inductors. This implementation saves area that would have been occupied by two separate inductors. FIG. 9B illustrates the reflection coefficient phase for the spiral layer 400. The reflection coefficient phase clearly passes through 0 degrees at 7 GHz and 13 Ghz.

Figure 9C:
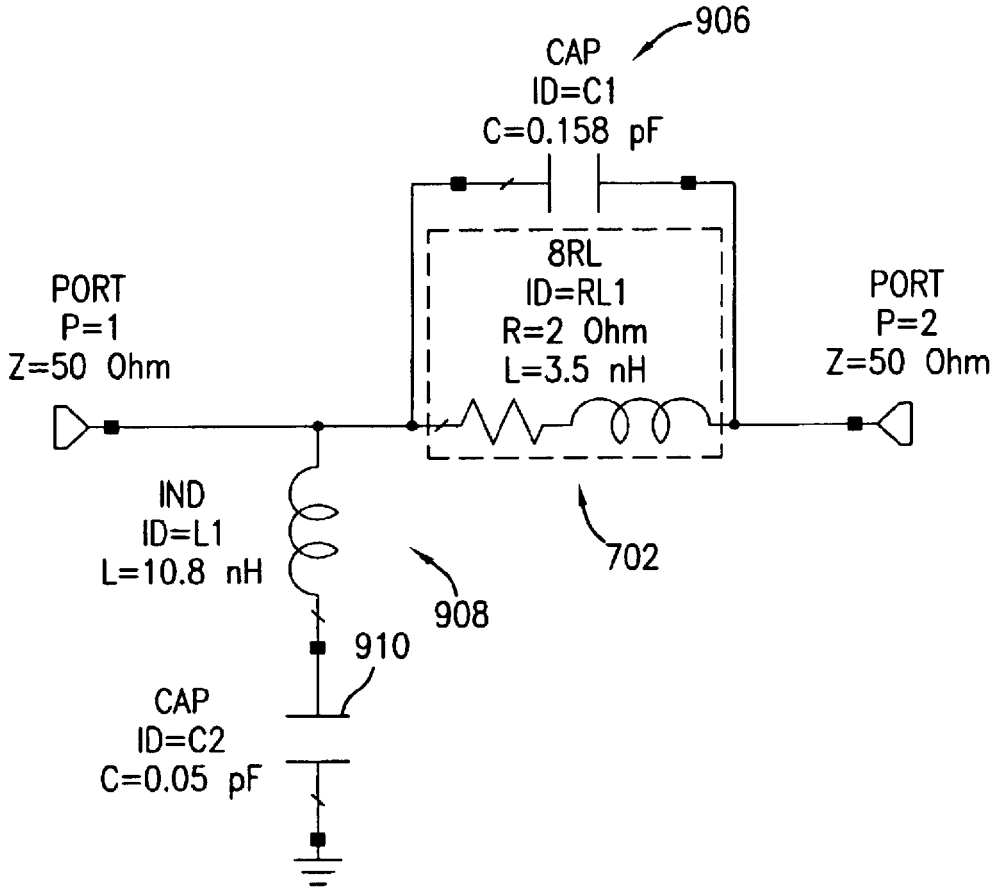
FIG. 9C illustrates an equivalent circuit for an inductor with a magnetic interface according to embodiments of the invention.
Figure 9D:
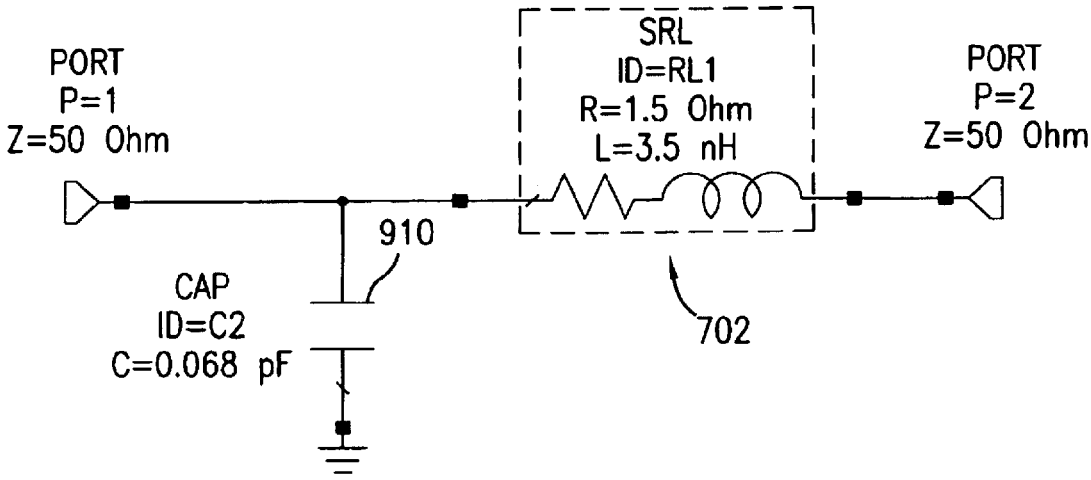
FIG. 9D illustrates an equivalent circuit for a conventional inductor without a magnetic interface.

The effects of the magnetic interface 410 can be described by the circuit model of FIG. 9C, which shows the printed inductor model along with the model of the magnetic interface. For comparison, FIG. 9D shows the circuit model for the conventional inductor 702 that is printed on a top surface of a substrate 704 without the magnetic interface. The large inductance 908 to the ground in FIG. 9C is provided by the magnetic interface and can not be obtained by standard homogeneous substrates. The inductance 908 accounts for the second inductive mode of the system's impedance (e.g. mode 904 in FIG. 9A). The capacitors 910 represent circuit parasitics. Therefore, the magnetic interface provides a host of applications for dual-mode operation of inductors that are printed on such magnetic surfaces.

The magnetic interface 410 suppresses the surface waves (or equivalently, shields the substrate) and reduces the cross talk/improves antenna gain, due to a photonic bandgap at the frequencies of operation (of the magnetic surface), which can be represented by a bandstop filter. A schematic description of the bandstop filtering property is provided by the equivalent circuit in FIG. 9C, which also provides a very good fit to the electromagnetic simulation data. The difference between FIG. 9D (simple inductor) and FIG. 9C (inductor+magnetic interface) is precisely the difference between a low-pass filter (e.g. simple inductor 702) and a stop-band filter (which the inductor 702+magnetic interface is) as derived from a low-pass prototype. The extra capacitor 906 in FIG. 9C that is in parallel with the inductor 702 contributes to the stopband of the magnetic interface. The shunt capacitors 910 is a parasitic associated with the substrate that generally cannot be avoided. The schematics shown in FIGS. 9C and 9D fit the corresponding electromagnetic simulation when the second port of the inductor (e.g. port 2 in FIGS. 9C and 9D) is grounded, as is usually the case.

The value of the inductance to the ground, and the associated capacitance on the series inductance can be tailor-designed and derived directly from the layout of the magnetic interface generator used to construct the magnetic interface. This in turn can tune the second inductive mode of the inductor to a desired frequency band.

4b. Crosstalk Suppression

Figure 10A:
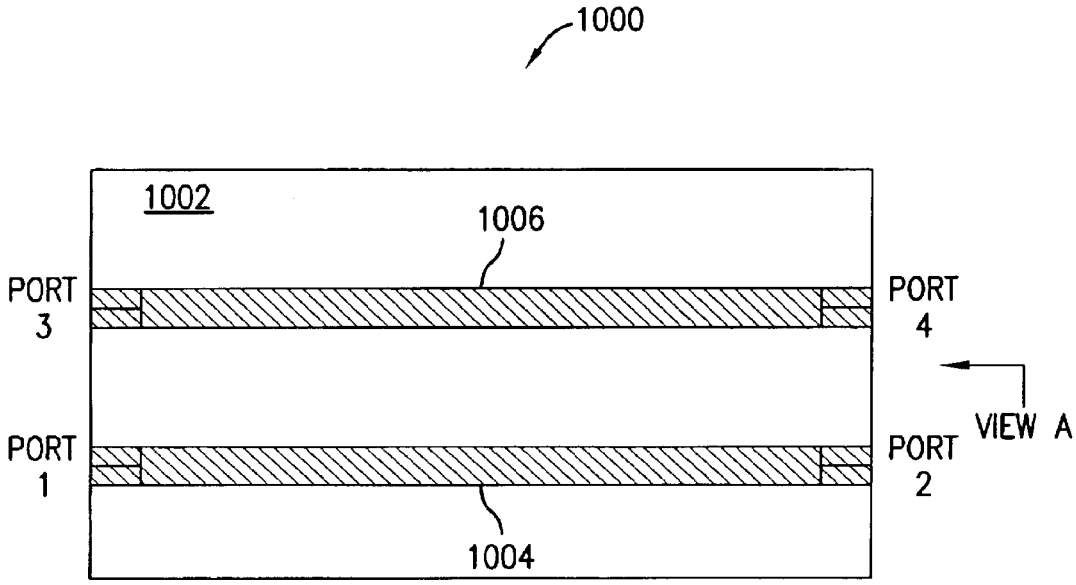
FIGS. 10A and 10B illustrate conventional coupled microstrip lines.
Figure 10B:
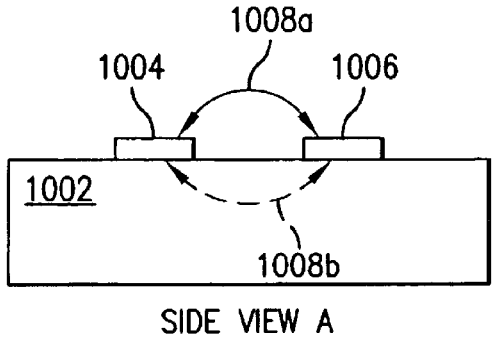

FIGS. 10A and 10B illustrate a circuit 1000 having two coupled mircostrip lines 1004 and 1006 that are printed on a substrate 1002. The coupled microstrip lines have ports 1–4 as shown. Mircostrip is a common transmission line that used in RF circuits to carry RF signals. The microstrip lines 1004 and 1006 are sufficiently close to each other that energy is coupled from one mircostrip to the other. As shown FIG. 10B, a RF signal 1008 on either microstrip line is coupled through the substrate 1002, and through the air to the other microstrip line. The signal coupling illustrated in FIG. 10B is often referred to as crosstalk, and leads to signal interference. Crosstalk occurs in microstrip circuits because traverse magnetic (TM) and traverse electric (TE) surface waves are excited within a dielectric substrate. These surface waves propagate parallel to the air-surface interface decaying exponentially away from it. Surface waves are often illustrated in a dispersion diagram that is a plot of $\beta$ vs. $\omega$. These surface waves are undesirable because they lead to energy loss and signal interference. Microstrip lines on conventional circuits are typical spaced far apart so as to avoid crosstalk. However, by spreading apart the microstrip lines, circuit density is reduced and the overall circuit size is increased.

Figure 11A:
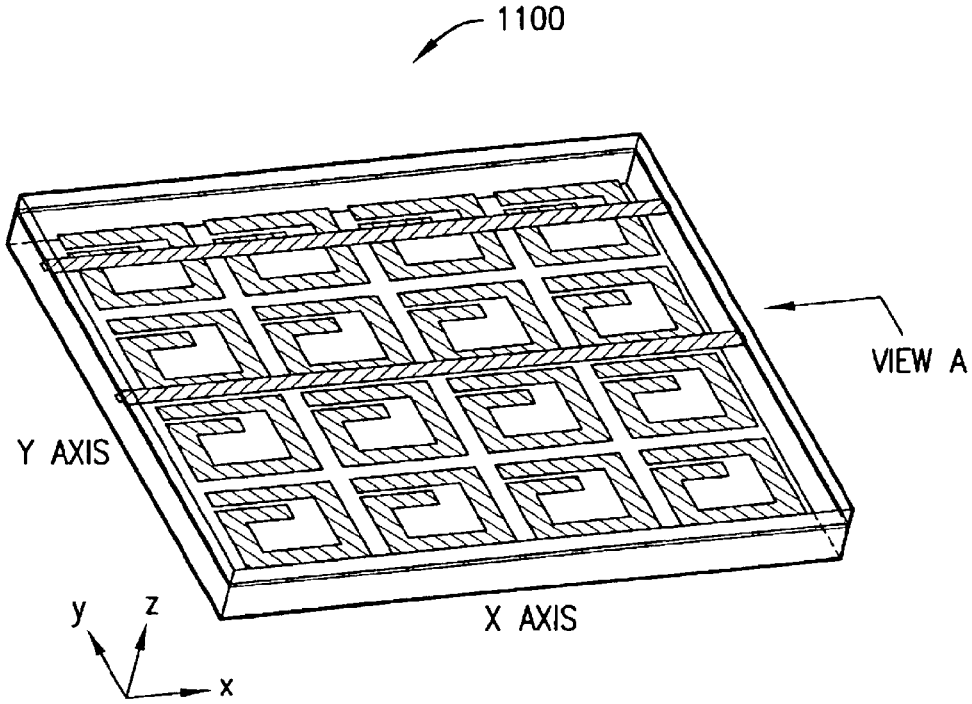
FIGS. 11A and 11B illustrate a microstrip circuit 1100 that utilizes a magnetic interface to reduce the crosstalk between mircostrip lines according to embodiments of the present invention.
Figure 11B:
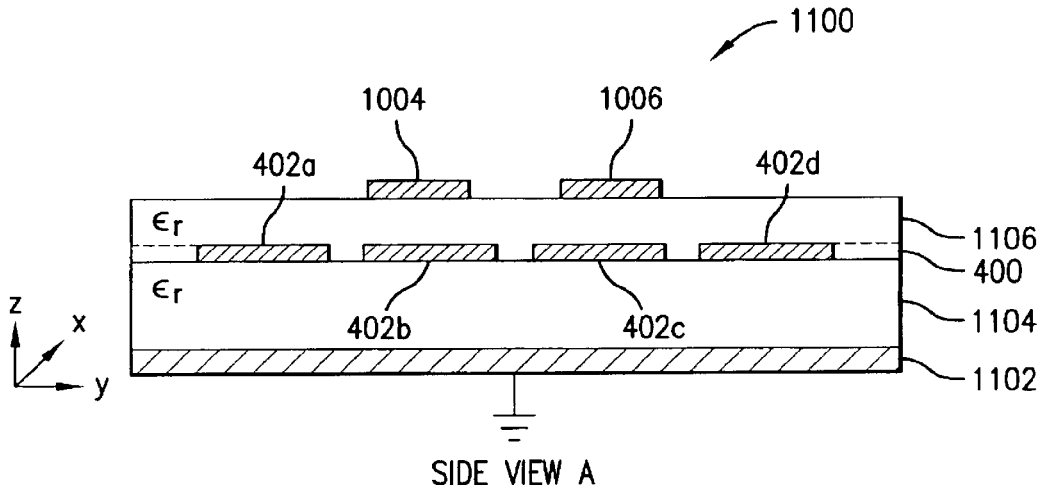

FIGS. 11A and 11B illustrate a circuit 1100 that utilizes a magnetic interface to reduce the crosstalk between the mircostrip lines 1004 and 1006. Referring to FIG. 11B, the circuit 1100 includes a ground layer 1102, a first substrate layer 1104, the magnetic interface generator (or "spiral layer") 400 having the array of spirals 402, a second substrate layer 1106, and the coupled microstrip lines 1004 and 1006. The spiral layer 400 is printed on the first substrate layer 1104, and is therefore sandwiched between the first substrate layer 1104 and the second substrate layer 1106. The microstrip lines 1004 and 1006 are then printed on top of the second layer 1106. The spacing S between the spirals 402 is configured so that the magnetic interface 410 appears on the top of the surface 1106. In other words, the spacing S between the spirals 402 is set so that the magnetic interface 410 generated by the spiral layer 400 is in the same xy plane as the spiral layer 400.

Figure 12:
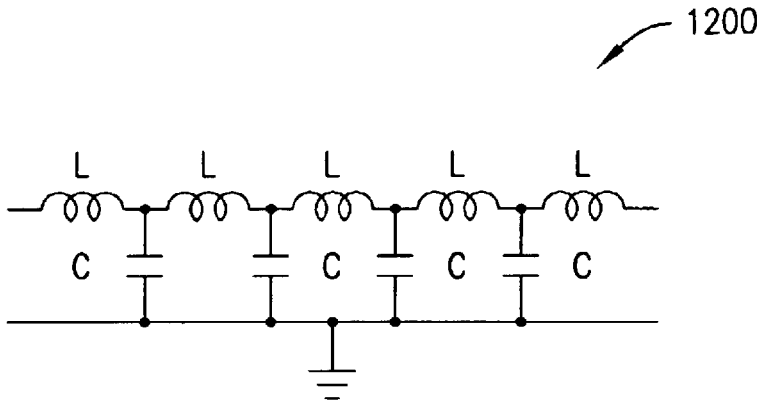
FIG. 12 illustrates the equivalent circuit that is seen by surface waves when using the magnetic interface according to embodiments of the present invention.

The magnetic interface generated by the spiral layer 400 suppresses the surface waves that lead to crosstalk. FIG. 12 illustrates an equivalent circuit 1200 that is seen by the surface waves that are traveling in the plane of the magnetic interface generated by the spiral layer 400. As shown, the circuit 1200 is a lowpass filter that suppresses TE and TM surface waves, and thereby suppresses or reduces crosstalk.

Figure 13:
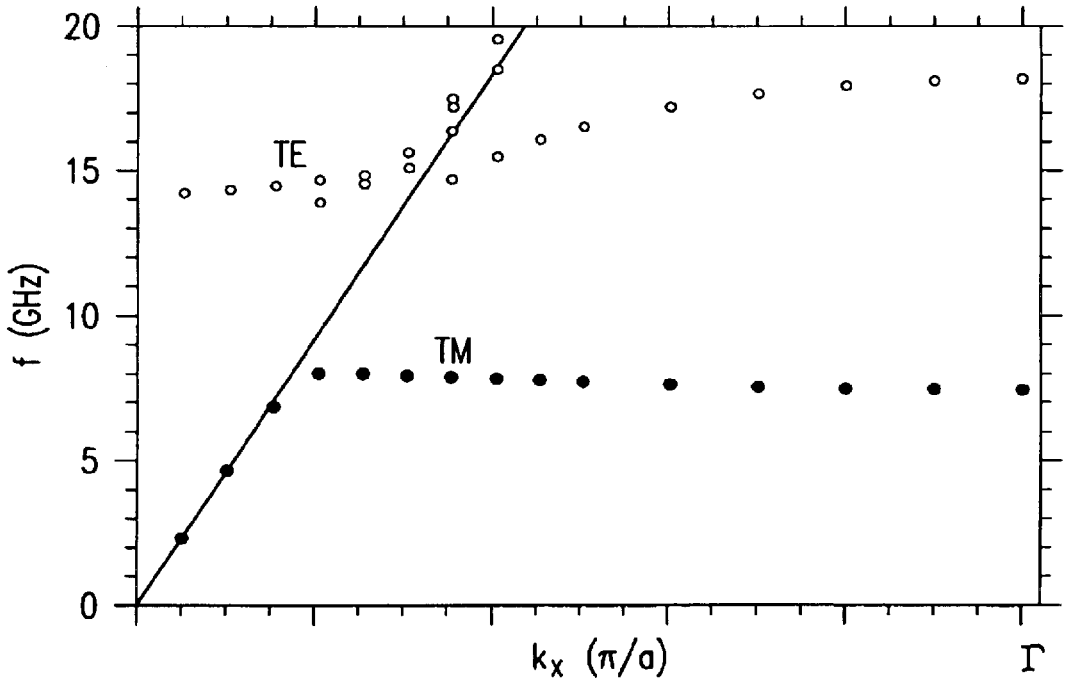
FIG. 13 represents TE and TM surface wave propagation on a substrate when using a magnetic interface according to embodiments of the present invention.

FIG. 13 illustrates a dispersion diagram for the TE and TM surface waves on a magnetic interface that is resonant at 8 Ghz made of rectangular spirals in duriod. The TE waves are presented by the empty dots, and the TM waves are represented by the filled dots. As shown, there is an absence of both TE and TM surface waves between 10–14 Ghz.

Figure 14:
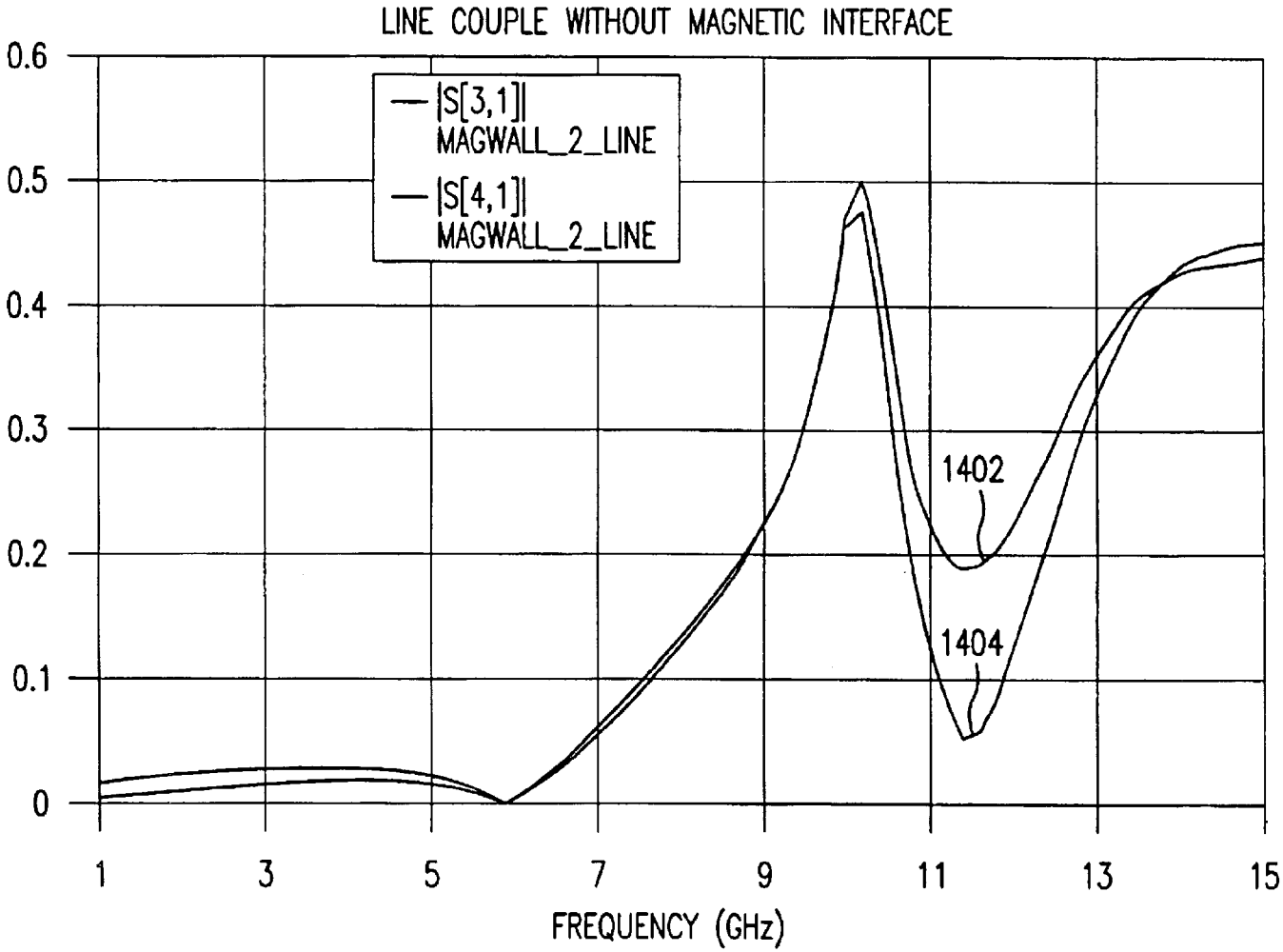
FIG. 14 illustrates coupling between parallel microstrip lines without using a magnetic interface.
Figure 15:
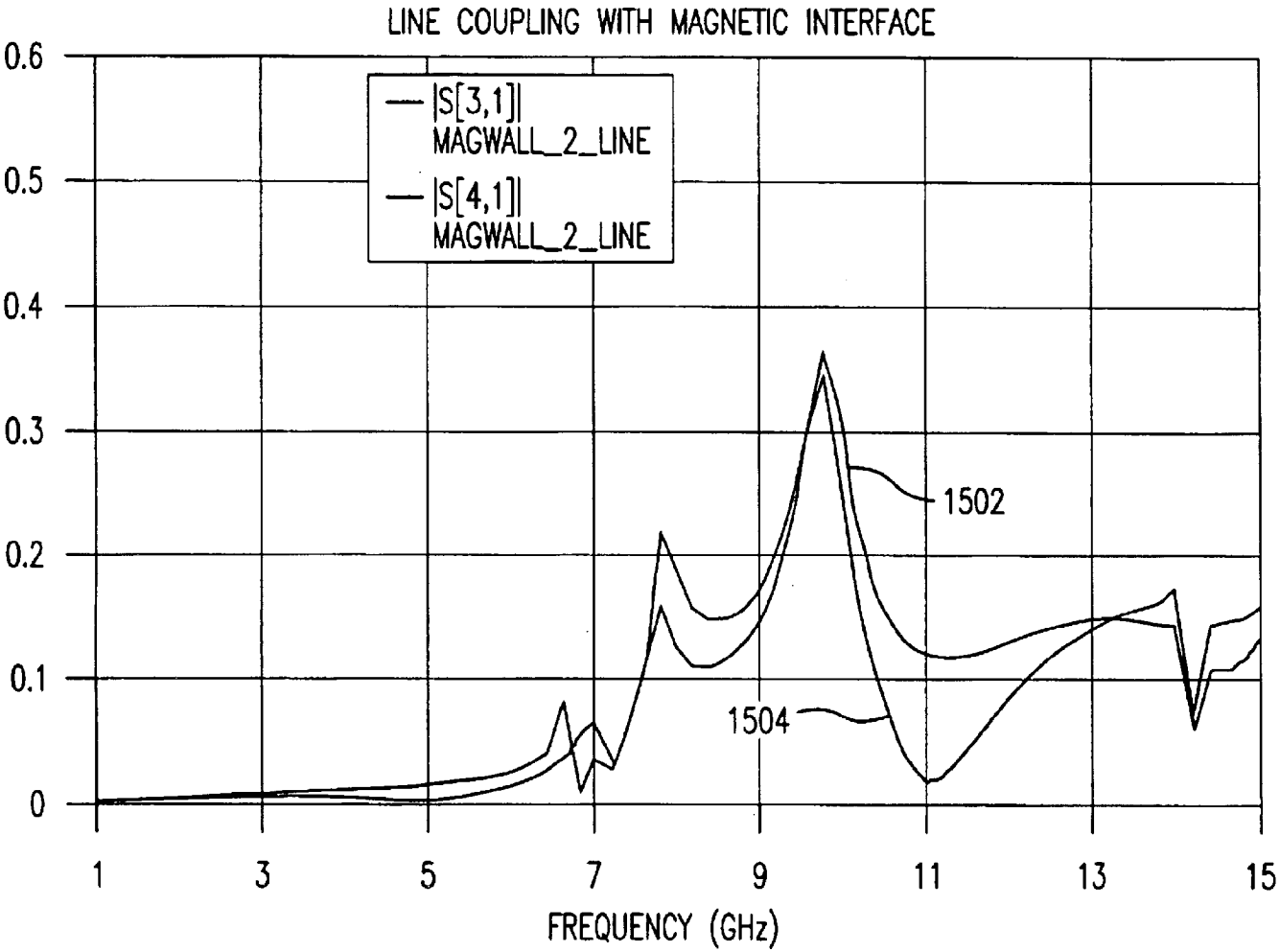
FIG. 15 illustrates coupling between parallel microstrip lines with a magnetic interface according to embodiments of the present invention.

FIGS. 14–15 further illustrate crosstalk suppression using s-parameter measurements.

FIG. 14 illustrates the level of crosstalk for the circuit 1000, which does not have the spiral layer 400. More specifically, FIG. 14 illustrates the signal detected at ports 3 and 4 given a signal input at port 1. Curve 1402 represents the signal level coupled to port 3 over frequency, and curve 1404 represents the signal level coupled to port 4 over frequency. As shown, the maximum coupling occurs at approximately 10 GHz and is approximately 0.5 to each of ports 3 and 4. In other words, at 10 GHz, one-half of the signal power that is input into port 1 is coupled to port 3, and the other half of the signal power is coupled to port 4.

FIG. 15 illustrates the level of crosstalk for the circuit 1100, which does have the spiral layer 400 according to embodiments of the present invention. Referring to FIG. 15, curves 1502 and 1504 represent the signal level coupled to ports 3 and 4, respectively, for a signal input to port 1. As shown, the maximum coupling still occurs at 10 GHz. However, the maximum coupling is reduced from approximately 0.5 (without the magnetic interface) to approximately 0.35 (with the magnetic interface). The magnetic interface generated by the spiral layer 400 suppresses the TE and TM surface waves sufficiently so that the maximum crosstalk between the lines 1004 and 1006 is reduced by approximately 30%. Therefore, for a given coupling specification, the spiral layer 400 allows mircostrip lines (and other transmission lines) on an RFIC to be placed closer together. By placing transmission lines closer together, chip densities are increased which improves manufacturing yield and reduces IC cost.

Figure 16:
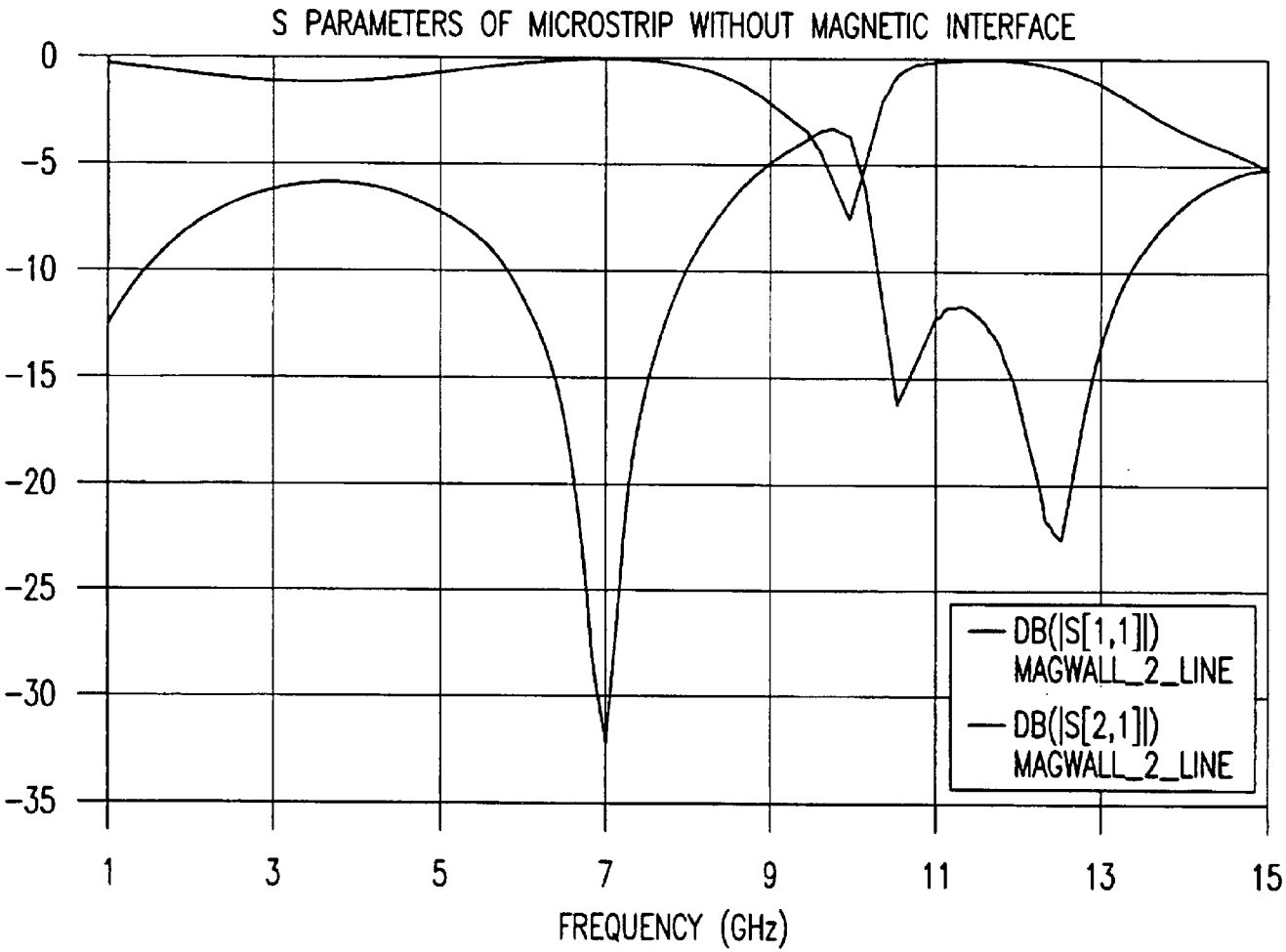
FIG. 16 illustrates reflection and transmission s-parameters for coupled microstrip lines that do not have the magnetic interface.
Figure 17:
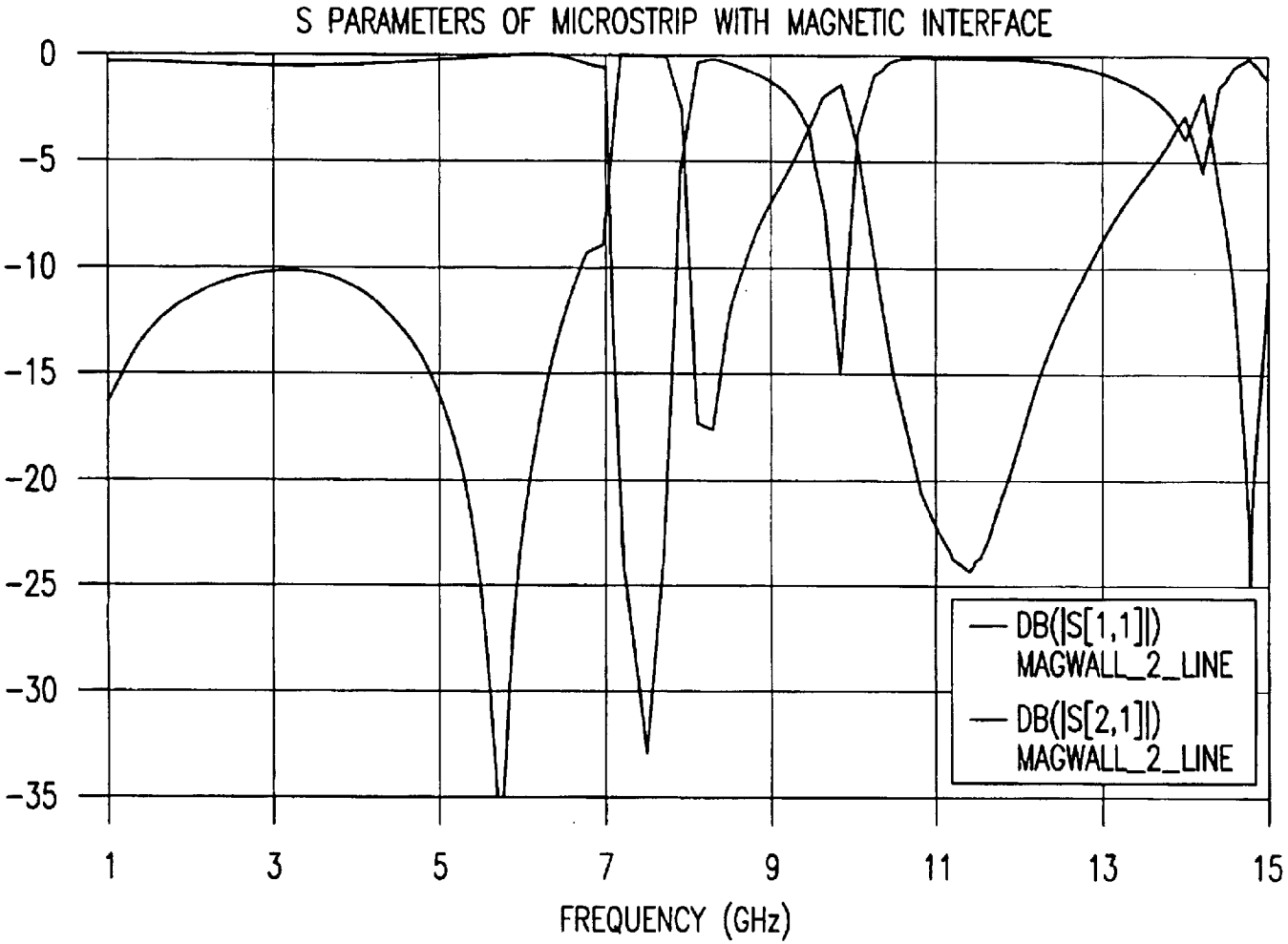
FIG. 17 illustrates reflection and transmission s-parameters for coupled microstrip lines that do have the magnetic interface according to embodiments of the present invention.

For completeness, FIGS. 16 and 17 illustrate the remaining s-parameters for the circuits 1000 and 1100. More specifically, FIG. 16 illustrates s11 and s21 for the circuit 1000, which does not have the spiral layer 400. FIG. 17 illustrates s11 and s21 for the circuit 1100, which does have the spiral layer 400.

4c. Antenna Gain

Mircostrip antennas are a common type of antenna that are used in various wireless applications, including communications applications and radar applications. A mircostrip antenna includes a metallization patch that is printed on a dielectric substrate. Microstrip antennas are a popular choice for wireless applications because of their planer structure, ease of manufacture, and because they can be made on a common substrate with other RFIC components. The antenna gain (or directivity) of a microstrip patch antenna typically increases with the area of the patch metallization.

Figure 18A:
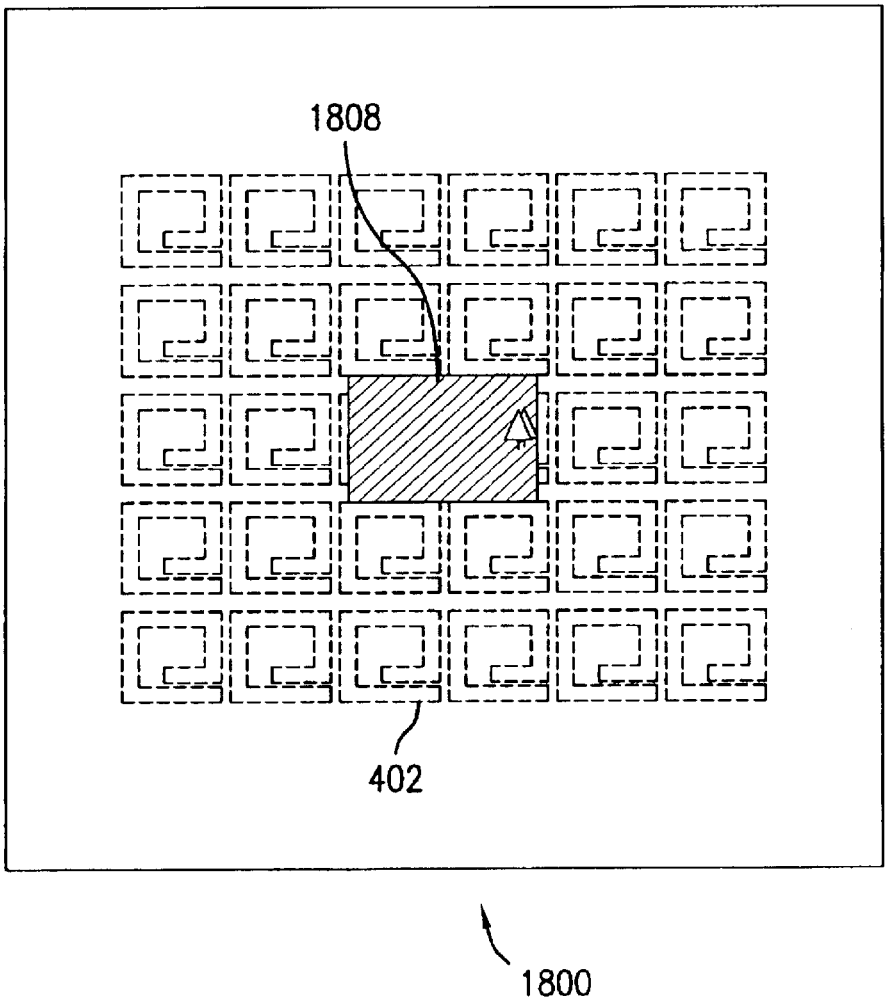
FIGS. 18A and 18B illustrate a mircostrip patch antenna that utilizes a magnetic interface to increase the antenna gain according to embodiments of the present invention.
Figure 18B:
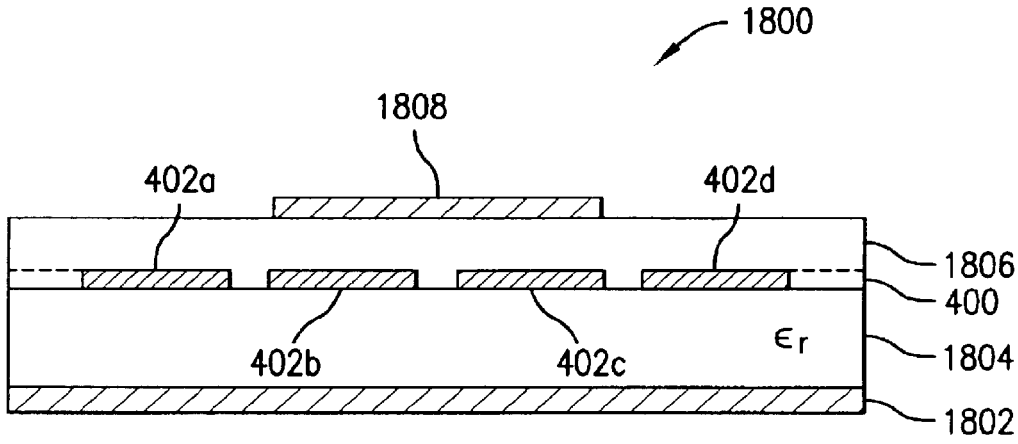

FIGS. 18A and 18B illustrate a circuit 1800 that utilizes a magnetic interface to increase the antenna gain of a microstrip patch antenna 1808. Referring to FIG. 18B, the circuit 1800 includes a ground layer 1802, a first substrate layer 1804, the spiral layer 400 having the array of spirals 402, a second substrate layer 1806, and a mircostrip patch antenna 1808. The spiral layer 400 is printed on the first substrate layer 1804, and is therefore is sandwiched between the first substrate layer 1804 and the second substrate layer 1806. The microstrip patch antenna 1808 is then printed on the top surface of the second layer 1806. The spacing S between the spirals 402 is configured so that the magnetic interface generated by the spirals 402 appears on the top of the surface 1806, in the same plane as is the microstrip patch antenna 1808. In embodiments, the number of spirals 402 needed to effect the magnetic interface as described herein can be 3 to 4 spirals around the microstrip patch 1808.

Figure 19:
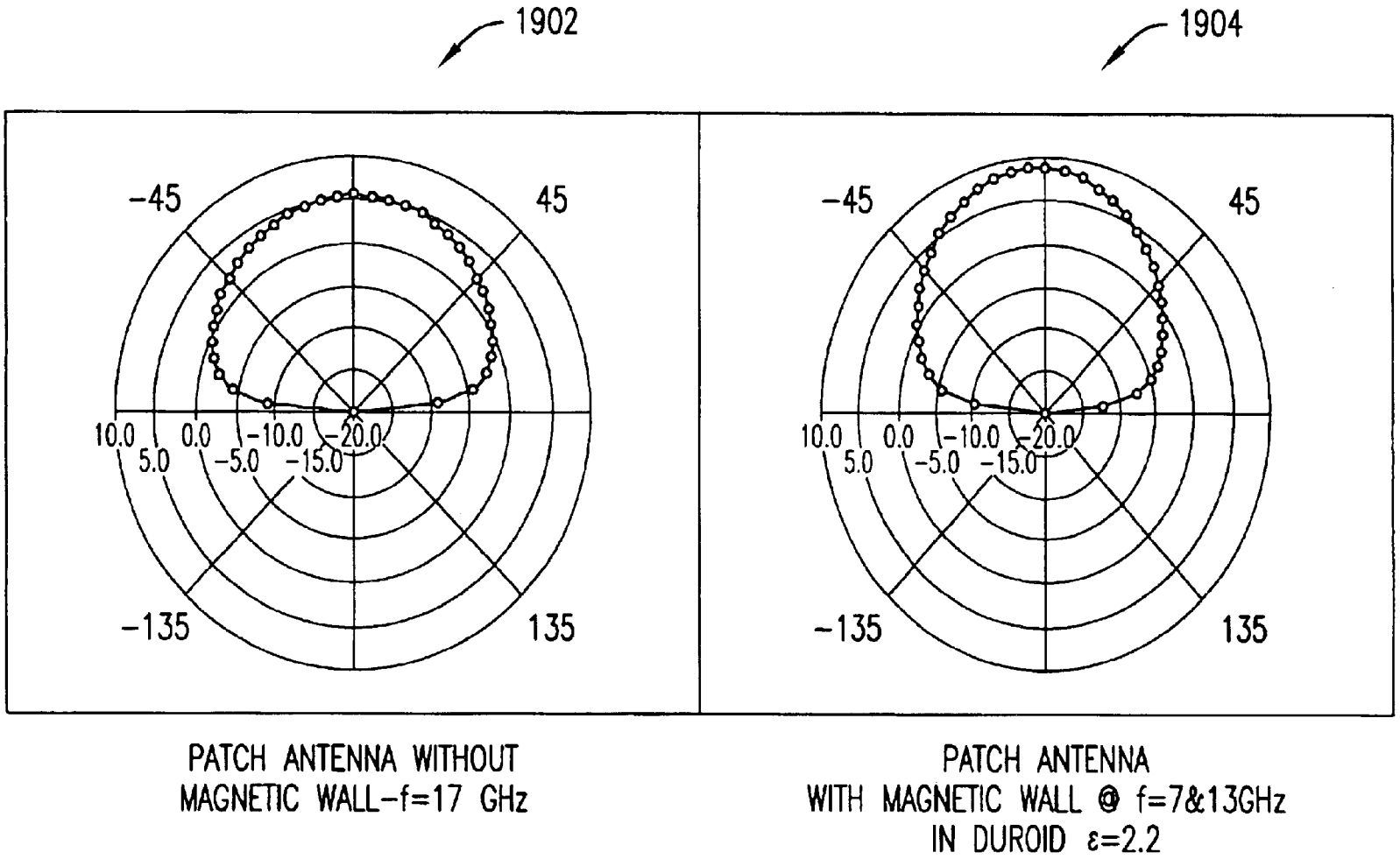
FIG. 19 compares the antenna gain for a patch antenna with and without the magnetic interface described herein.

FIG. 19 compares the antenna patterns of a microstrip patch antenna using a magnetic interface, with a microstrip antenna that does not utilize a magnetic interface. More specifically, pattern 1902 represents the antenna pattern for a conventional patch antenna without a magnetic interface. Pattern 1904 represents the same patch antenna utilizing the magnetic interface as provided in FIG. 19A. Antenna gain is measured radially on the patterns 1902 and 1904 and is gauged from −20 to 10. Maximum gain for the pattern 1902 (without the magnetic interface) is approximately 5.0 and occurs at 0 degrees (or broadside). Maximum gain for the pattern 1904 (with the magnetic interface) is approximately 8.0 and also occurs at broadside. In other words, for the same patch area, antenna gain with the magnetic interface is approximately 60% higher than without the magnetic interface. The increase in antenna gain is caused by the suppression of surface waves achieved by the magnetic interface. This suppression leads to a higher percentage of radiated power relative to input power, which is the gain increase illustrated. The increased antenna gain proportionally improves the received signal level, and therefore the signal-to-noise ratio. Alternatively, for a desired gain, the size of the patch antenna can be reduced by utilizing the magnetic interface as described herein, thereby taking up less substrate area.

4d. Antenna Matching and Bandwidth

Conventional microstrip antennas often present performance limitations regarding the level of matching of their input impedance to the impedance of their feeding circuitry. In general, it is desirable to have microstrip antennas with a return loss (s11) as small as possible, at the operating frequency. Further, for many applications, it is desirable to have antennas that present good impedance matching over a fairly large bandwidth. Conventional printed antennas, however, only have a narrow bandwidth, typically of 4–8% as traditionally quantified at the −10 dB-level. The present invention improves the state-of-the-art in both these areas, by use of the magnetic interface described herein.

Figure 20:
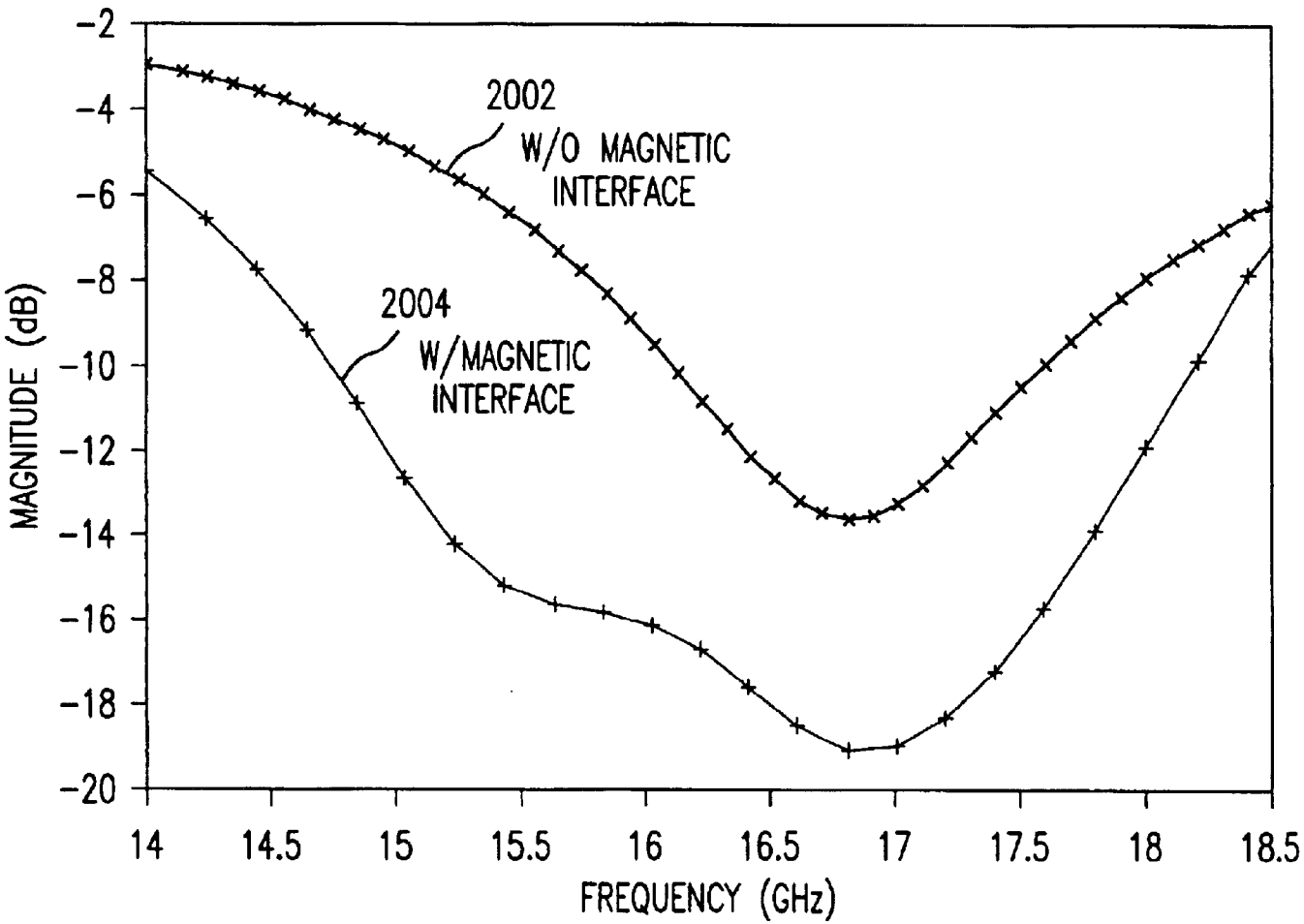
FIG. 20 compares the return loss for a microstrip patch antenna with and without the magnetic interface.

FIG. 20 compares the return loss (s11) of a patch antenna having a magnetic interface, with a patch antenna that does not have a magnetic interface. More specifically, the curve 2002 represents the return loss for a microstrip patch that does not utilize the magnetic interface. The curve 2004 represents the return loss for the same patch antenna having the magnetic interface as provided in FIGS. 18A–18B. The maximum return loss for the curve 2004 (with the magnetic interface) is approximately 18 dB verses only 14 dB for the curve 2002 (without the magnetic interface). The curve 2004 also has a broader bandwidth. Specifically, the printed antenna of this example without the magnetic interface has a −10 dB bandwidth of 8.5%, as computed from the curve 2002. The same antenna printed on the magnetic interface has a −10 dB bandwidth of 21%, as computed from the curve 2004, which is 150% larger than without the magnetic interface. Therefore, the patch antenna with the magnetic interface has a better overall impedance match than the patch antenna without the magnetic interface.

5. Conclusion

Example embodiments of the methods, systems, and components of the present invention have been described herein. As noted elsewhere, these example embodiments have been described for illustrative purposes only, and are not limiting. Other embodiments are possible and are covered by the invention. Such other embodiments will be apparent to persons skilled in the relevant art(s) based on the teachings contained herein. Thus, the breadth and scope of the present invention should not be limited by any of the above-described exemplary embodiments, but should be defined only in accordance with the following claims and their equivalents.

What is claimed is:

1. A circuit that generates a magnetic interface for electromagnetic signals having a center frequency $f_0$, comprising:

a substrate having a first surface and a second surface, wherein a conductive portion of said first surface is coupled to a ground node; and a planar array of spirals deposited on said second surface of said substrate, wherein each spiral has an average track length $D_{av}$ that is selected according to the center frequency $f_0$, said planar array of spirals arranged in a plurality of rows and columns;

wherein said magnetic interface is generated in a plane above said second surface.

2. The circuit of claim 1, wherein said average track length $D_{AV}$ is determined according to the following:

$$D_{av} = \frac{c}{2f_0\sqrt{\frac{1+\varepsilon_r}{2}}}$$

wherein c represents a speed of light; and wherein $\in_r$ represents a relative dielectric constant of said substrate.

3. The circuit of claim 1, wherein a first terminal and a second terminal of each spiral is open circuited.

4. The circuit of claim 1, wherein said planar array of spirals generates said magnetic interface at a distance Z above said second surface, wherein said distance Z is determined based on a spacing S between said spirals.

5. The circuit of claim 1, wherein said planar array of spirals generates said magnetic interface at a distance Z above said second surface, where said distance Z is determined based on a cell size of said planar array of spirals, wherein said cell size includes a length L of a spiral and a spacing S of said spiral.

6. The circuit of claim 1, wherein said planar array of spirals include metallization that is printed on said substrate.

7. A device, comprising:

a substrate layer having a first surface and a second surface, wherein a conductive portion of said first surface is coupled to a ground node;

a spiral layer having a planar array of spirals, printed on said second surface of said substrate, that generates a magnetic interface above said second surface for electromagnetic signals at a center frequency $f_0$, said planar array of spirals arranged in a plurality of rows and columns; and wherein said center frequency $f_0$ is determined by an average track length $D_{av}$ for said spirals.

8. The device of claim 7, wherein $f_0$ is determined according to the following equation:

$$f_0 = \frac{c}{2D_{av}\sqrt{\frac{1+\varepsilon_r}{2}}};$$

wherein c represents a speed of light, and wherein $\in_r$ represents a relative dielectric constant of said substrate.

9. The device of claim 7, wherein a first terminal and a second terminal of each spiral in said planar array of spirals is open circuited.

10. The device of claim 7, wherein said magnetic interface is generated at a distance Z above said second surface of said substrate, wherein said distance Z is determined based on a cell size of a spiral in said planar array of spirals.

11. The device of claim 7, further comprising:

a second substrate layer having a first surface coupled to said planar array of spirals and a second surface; and a circuit that is printed on said second surface of said second substrate.

12. The device of claim 11, wherein said magnetic interface is generated approximately in a plane of said second surface of said second substrate.

13. The device of claim 11, wherein said circuit is a passive circuit.

14. The device of claim 11, wherein said circuit is an active circuit.

15. The device of claim 11, wherein said circuit includes an inductor.

16. The device of claim 11, wherein said circuit includes a pair of transmission lines.

17. The device of claim 16, wherein said pair of transmission lines are a pair of microstrip lines.

18. The device of claim 11, wherein a cell size of said spirals is adapted so that said magnetic interface is generated approximately in a plane of said circuit.

19. The device of claim 18, wherein said cell size is determined by a length L of a spiral arm and a spacing S between said spirals.

20. A device, comprising:

a ground layer;

a first substrate layer having a first surface and a second surface, a conductive portion of said first surface coupled to said ground layer;

a spiral layer having a planar array of spirals that are printed on said second surface of said first substrate layer, said planar array of spirals arranged in a plurality of rows and columns;

a second substrate layer having a first surface and a second surface, said first surface of said second substrate layer coupled to said spiral layer;

a circuit printed on a second surface of said second substrate layer; and wherein said spiral layer generates a magnetic interface centered at a frequency $f_0$ in a plane of said circuit, and wherein said center frequency $f_0$ is determined by an average track length $D_{av}$ of said spirals.

21. The device of claim 20, wherein said average track length $D_{AV}$ is determined according to the following equation:

$$D_{av} = \frac{c}{2f_0\sqrt{\frac{1+\varepsilon_r}{2}}}$$

wherein c represents a speed of light; and wherein $\in_r$ is a relative dielectric constant of said substrate.

22. The device of claim 20, wherein a cell size of said planar array of spirals is based on a thickness of said second substrate layer, wherein said cell size includes a length L of a spiral arm and a spacing S between adjacent spirals.

23. The device of claim 20, wherein said terminals of said spirals are open circuited.

24. The device of claim 20, wherein said circuit is an inductor.

25. The device of claim 20, wherein said circuit includes at least two transmission lines.

26. The device of claim 25, wherein said transmission lines are microstrip lines.

* * * * *

UNITED STATES PATENT AND TRADEMARK OFFICE

CERTIFICATE OF CORRECTION

PATENT NO. : 6,906,682 B2
DATED : June 14, 2005
INVENTOR(S) : Alexopoulos et al.

It is certified that error appears in the above-identified patent and that said Letters Patent is hereby corrected as shown below:

Column 4,
Lines 7, 10, 11 and 60, please delete "$E_1$" and insert -- $E_i$ --;
Line 65, (equation 1), please delete "$E_1$" and insert -- $E_i$ --;

Column 6,
Line 50, please delete "$E_1$" and insert -- $E_i$ --; and
Line 55, (equation 2), please delete "$E_1$" and insert -- $E_i$ --.

Signed and Sealed this

First Day of November, 2005

JON W. DUDAS
*Director of the United States Patent and Trademark Office*